US006015958A

United States Patent [19]

Pomatto et al.

[11] Patent Number: 6,015,958

[45] **Date of Patent: *Jan. 18, 2000**

[54] RETROFIT SWITCH ACTUATOR

[75] Inventors: Lawrence A. Pomatto, Santa Ana; Ronald B. Tinkham, Solana Beach, both of Calif.

[73] Assignee: Systems Integrated, Orange, Calif.

[ * ] Notice: This patent is subject to a terminal disclaimer.

[21] Appl. No.: 08/778,670

[22] Filed: Jan. 3, 1997

Related U.S. Application Data

[63] Continuation-in-part of application No. 08/615,592, Mar. 12, 1996, Pat. No. 5,762,180.

[51] Int. Cl.[7] ..... H01H 3/20

[52] U.S. Cl. ..... 200/330; 200/329

[58] Field of Search ..... 200/330, 328, 200/331, 332.1, 337; 335/179, 173, 172

[56] References Cited

U.S. PATENT DOCUMENTS

| | | |
|---|---|---|
| 4,167,659 | 9/1979 | Yamanaka et al. . |
| 4,227,059 | 10/1980 | Ogawa . |
| 4,292,612 | 9/1981 | Howell . |
| 5,179,376 | 1/1993 | Pomatto . |
| 5,475,190 | 12/1995 | Smith et al. . |

*Primary Examiner*—David J. Walczak
*Attorney, Agent, or Firm*—Knobbe, Martens, Olson & Bear, LLP

[57] ABSTRACT

A retrofit switch actuator for a circuit breaker control switch in a power distribution network provides for remote control and automation of the control switch. A solenoid of the switch actuator is energized to move the output shaft of the solenoid. The movement of the solenoid output shaft is transferred by a connector mounted at one end to the solenoid output shaft and mounted at the other end to the control shaft of the circuit breaker to rotational movement of the control shaft. The motion of the control shaft mechanically engages the existing circuit breaker control switch.

34 Claims, 19 Drawing Sheets

RETROFIT SWITCH ACTUATOR

The present application is a continuation-in-part of application Ser. No. 08/615,592 filed Mar. 12, 1996 now U.S. Pat. No. 5,762,180.

BACKGROUND OF THE INVENTION

1. Field of the Invention

The present invention relates to retrofitting a power substation circuit breaker control switch for automation and remote control. Specifically, a switch actuator is installed in the substation, leaving the existing circuit breaker control switch pistol grip control in place, to provide manual or remote control of the circuit breaker control switch.

2. Description of Related Art

Typically, power substations are monitored on-site by personnel that check panel indicator lights of a circuit breaker system to determine whether an alarm condition exists which requires opening the circuit. When an alarm condition is recognized, a crew member manually turns a pistol grip which operates the circuit breaker control switches. Once activated, the switches control a number of individual switching mechanisms within the circuit which ultimately open or close the circuit. By tripping the circuit, power distribution can be managed and harm to the system prevented.

In an effort to automate a power substation, one method proposed for controlling the circuits is to directly control the individual switching mechanisms using complex controls with new control components. However, such automation proposals require replacement of the substation hardware.

SUMMARY OF THE INVENTION

The present inventor recognized the need for a more efficient and cost-effective automation system to control a power substation circuit breaker. By retrofitting existing circuit breaker control switches with an actuator, the existing circuit breaker control switches may be remote controlled. The existing mechanical handle may also remain.

The present invention substantially reduces costs for automation of the circuit breaker control system. One advantage of the present invention is that it does not require an entirely new circuit breaker control system, or changing the components of the substation. Therefore, installation does not cause power outage or require existing control wiring to be changed.

The retrofit switch actuator of the present invention comprises a solenoid having a rotationally movable output shaft and an adapter which transfers the rotational movement of the solenoid output shaft to the control switch output shaft to activate the circuit breaker control switch. In a preferred embodiment, the adapter is rotatably mounted at one end to the output shaft of the solenoid and fixedly mounted at the other end to the control shaft of the circuit breaker control system. Rotation of the control shaft is initiated by rotational motion of the solenoid. Rotation of the control shaft simulates the motion created by manually rotating the pistol grip and, in turn, mechanically engages the circuit breaker control switch.

Advantageously, the solenoid is electrically linked to a control panel comprising power, ground, and trip and close signals for the solenoid. The control panel receives signals from the main monitoring system to energize and control the solenoid. When the solenoid is engaged, the output shaft or armature of the solenoid moves from a first solenoid position to a second solenoid position. In response to the movement of the solenoid output shaft via the adapter switch, the control shaft moves from a first rotational position to a second rotational position.

One embodiment of the present invention is a switch actuator for a circuit breaker control switch having a rotatable control switch output shaft. The switch actuator includes a solenoid having an axially movable output shaft and an adapter coupled to the axially movable output shaft and to the control switch output shaft. The adaptor converts axial movement by the axially movable output shaft into rotational motion which turns the control switch output shaft.

Another embodiment of the present invention is a switch actuator for a circuit breaker control switch having a rotatable control switch output shaft. The switch actuator comprises a solenoid having an output shaft producing a rotational movement and a connector coupled to the output shaft of the solenoid and to the control switch output shaft. The connector transfers rotational movement of the output shaft of the solenoid to the control switch output shaft to turn the control switch output shaft.

Another embodiment of the present invention is a retrofit switch actuator for a circuit breaker control switch in a power distribution network. The circuit breaker control switch has a control shaft movable from a first position to either a second position or a third position. The actuator comprises a first solenoid having a first output shaft producing a clockwise rotational movement and a second solenoid having a second output shaft producing counter-clockwise rotational movement. A connector is coupled to the first output shaft and the second output shaft. The connector transfers the clockwise rotational movement of the first output shaft to move the control shaft from the first position to the second position. The connector also transfers the counter-clockwise rotational movement of the second shaft to move the control shaft from the first position to the third position.

Another embodiment of the present invention is a switch actuator for a circuit breaker control switch having a rotatable control switch output shaft. The switch actuator comprises a solenoid having a first coil, a second coil and an output shaft. The first coil rotates the output shaft a first direction and the second coil rotates the output shaft a second direction. The second direction is opposite the first direction. A coupler connects the output shaft of the solenoid to the control switch output shaft. The coupler transfers the rotational movement by the output shaft of the solenoid to turn the control switch output shaft.

DETAILED DESCRIPTION OF THE PREFERRED EMBODIMENTS

Several embodiments of the present invention are described below. A first embodiment, illustrated in FIGS. 1–6, comprises a retrofit switch actuator 100 rear mounted to an existing circuit breaker control switch 112. A second embodiment, shown in FIGS. 7–12, comprises a front mounted switch actuator attached between a pistol grip and a wall panel of a circuit breaker control system.

Figure 1:
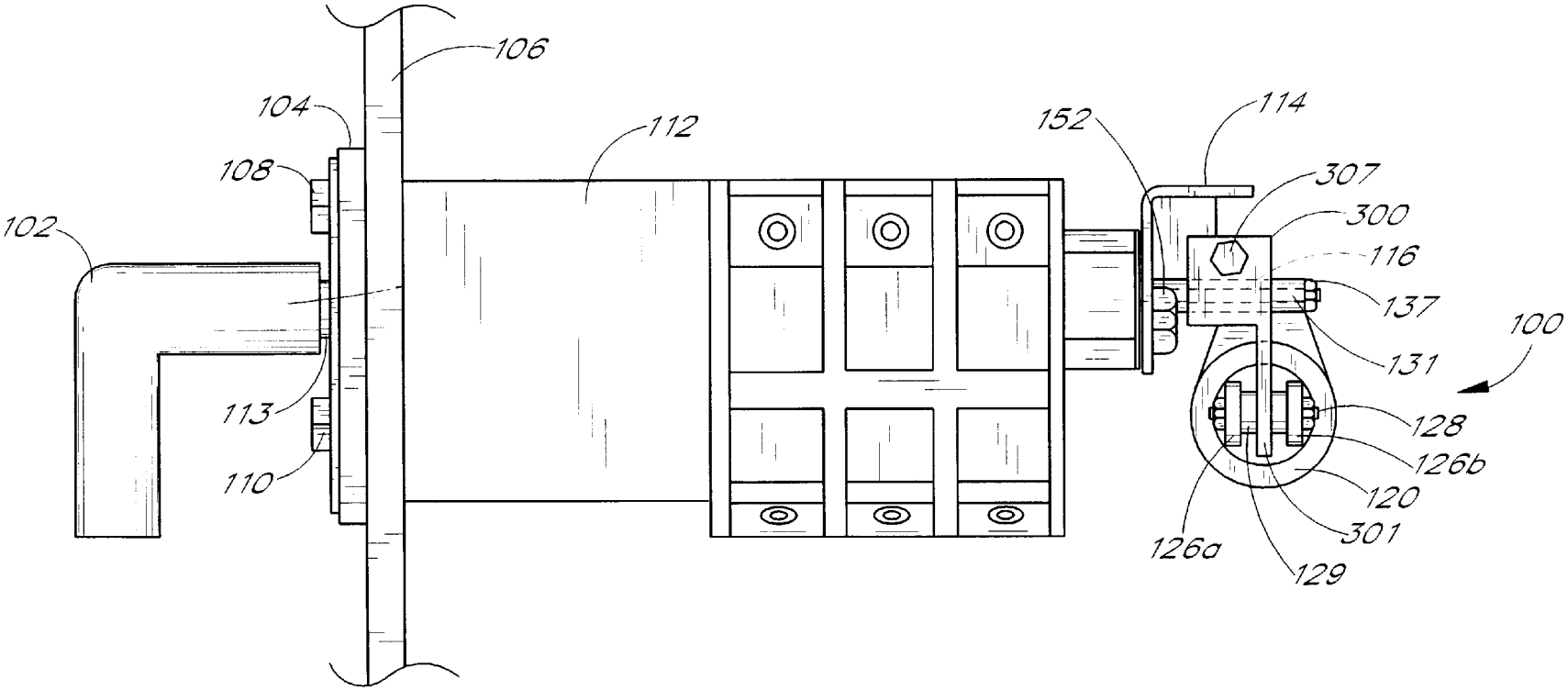
FIG. 1 depicts a side view of a retrofit switch actuator rear mounted to a control switch in accordance with a first embodiment of the present invention.

A front end view of a retrofit switch actuator 100 according to a first embodiment (the rear mount embodiment) of the present invention is shown in FIG. 1. FIG. 1 illustrates the rear mounted retrofit switch actuator 100 for a circuit breaker control switch 112. The circuit breaker control switch 112 has a pistol grip 102 on a control shaft 113. A switch mounting plate 104 holds the control switch 112 in place on a wall panel 106. The switch actuator 100 has a solenoid bracket 114, a lever adapter 300 mounted upon a control shaft extension 116, and a bi-directional solenoid 120.

A plurality of switch mounting plate fasteners 108, 110 (such as bolts) pass through the mounting plate 104 and sandwich the wall panel 106 between the control switch 112 and the switch mounting plate 104. Advantageously, the fasteners which attach the mounting plate 104 to the wall panel 106 comprise bolts for the control switch 112. The bolts extend through the wall panel 106 and through the mounting plate 104.

The control switch 112 controls a power substation circuit breaker (not shown). To manually trip the circuit breaker via the control switch 112, the pistol grip 102 of the control switch is rotated from a first position to a second position. Rotation of the pistol grip rotates the control shaft 113 upon which the pistol grip is mounted. The rotation of the control shaft 113 triggers the control switch 112 of the circuit breaker. Once activated, the control switch 112 signals switching mechanisms within the circuit which ultimately open or close the circuit breaker.

In accordance with a first embodiment of the present invention, the switch actuator 100 is rear mounted to the circuit breaker control switch 112, as depicted in FIGS. 1 and 2. A solenoid bracket 114 is installed at the back end of the control switch 112 over a control shaft extension 116 of the control switch shaft 113. The shaft extension 116 protrudes from the rear of the control switch 112.

Figures 2A, 2B:
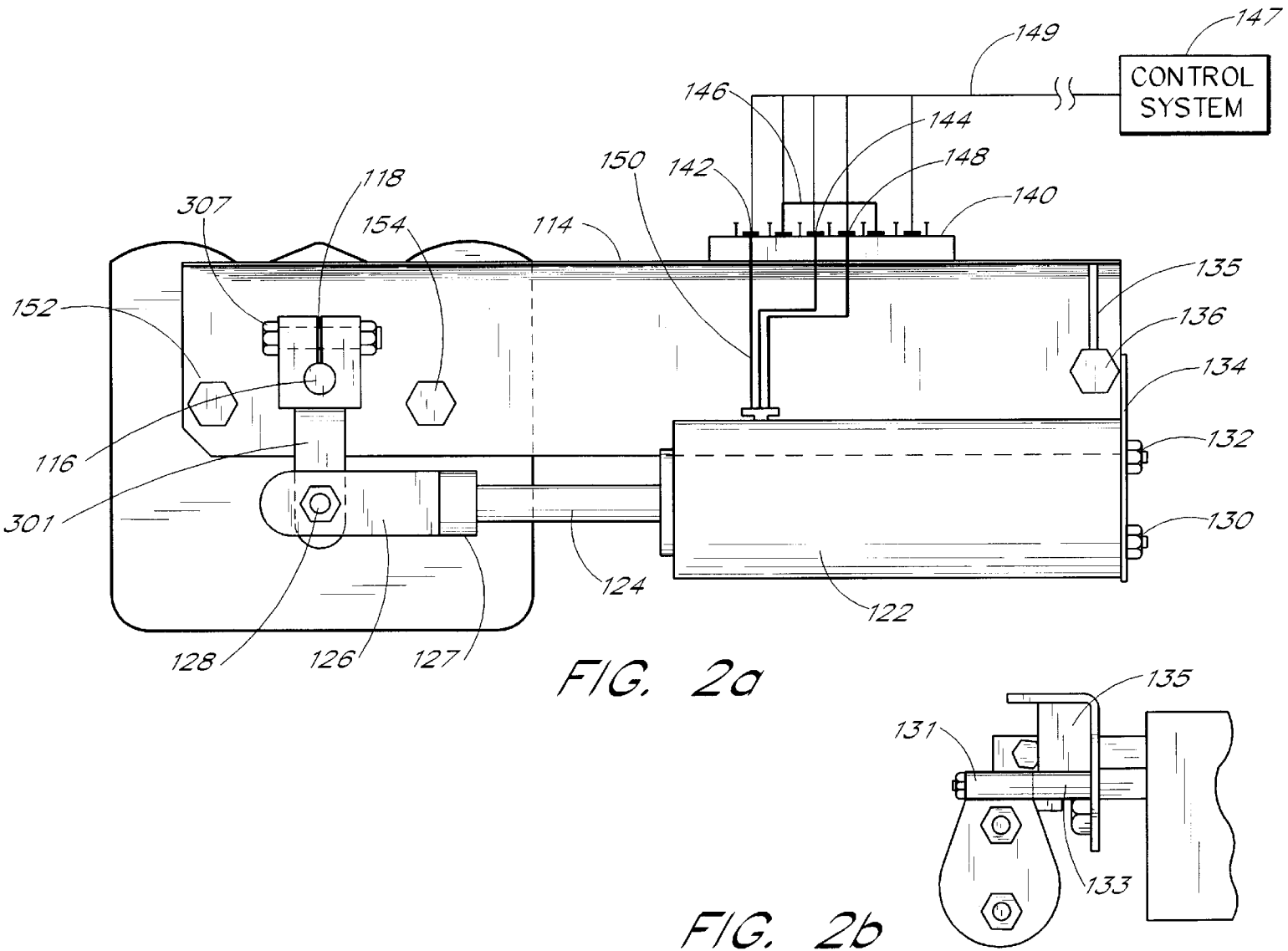
FIG. 2*a* is a rear view of the embodiment of the present invention shown in FIG. 1.
FIG. 2*b* depicts a back end view of the embodiment of the present invention shown in FIG. 1.
Figure 5:
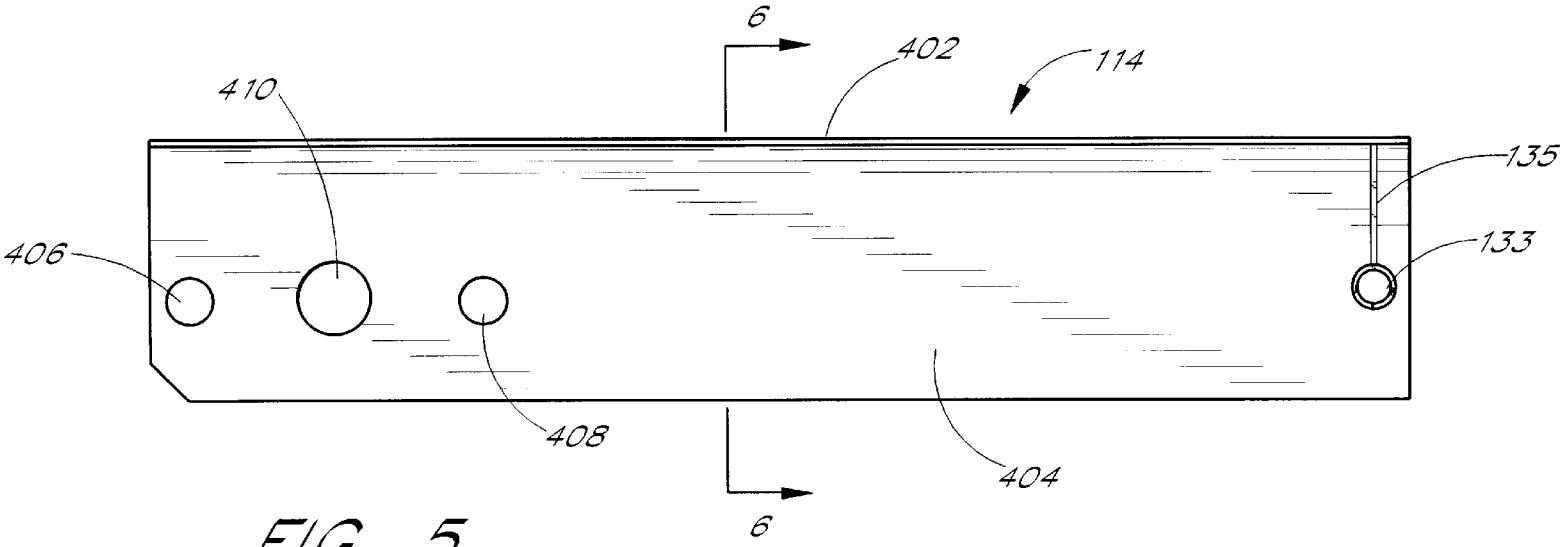
FIG. 5 depicts a side view of a solenoid bracket for the rear mounting embodiment of the present invention shown in FIG. 1.
Figure 6:
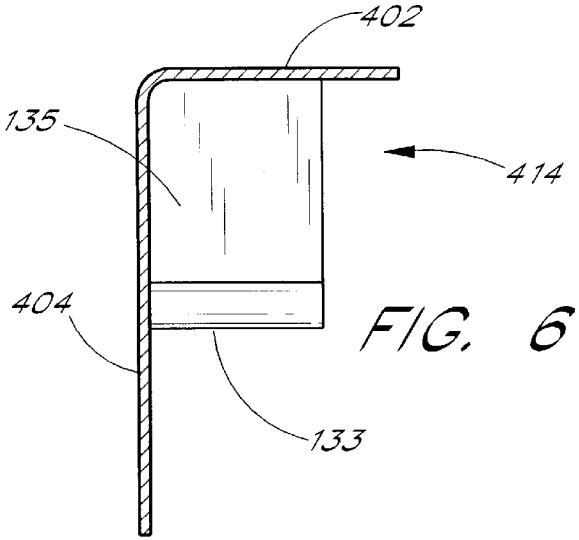
FIG. 6 is a cross-section of the solenoid bracket shown in FIG. 5.

The solenoid bracket 114 is illustrated in additional detail in FIGS. 5 and 6. The solenoid bracket 114 is rectangular in shape from a side view (FIG. 5) and has an L-shaped cross-section as seen in FIG. 6. The bracket is easily formed from stock, angle iron, angle aluminum or other high strength composite. The solenoid bracket 114 has mounting bolt through holes 406, 408, and shaft extension through hole 410. The mounting bolt through holes 406, 408 are for mounting bolts 152, 154 (FIG. 2*a*). The shaft extension through hole 410 is for the control switch extension shaft 116. The solenoid bracket 114 also has an internally threaded fixed sleeve portion 133 of a sleeve pivot for mounting the solenoid. A brace 135 is welded or otherwise bonded to the solenoid bracket 114 and to the fixed sleeve portion 133 to brace the fixed portion 133. The L-shape is formed by an upper plate 402 and a mounting plate 404 which form a 90° angle.

The solenoid bracket 114 attaches to the rear of the circuit breaker control switch 112 via the mounting bolts 152, 154 (FIG. 2*a*). The mounting bolt through holes 406, 408 accommodate the mounting bolts 152 and 154 which attach the solenoid bracket 114 to the existing circuit breaker control switch. The mounting bolts 152, 154 extend through the solenoid bracket apertures 406 and 408 and into the control switch 112.

The mounting portion 404 of the solenoid bracket further has the fixed sleeve portion 133 for the pivot 136 (FIG. 2*a*). The pivot 136 is additionally supported by the upper plate 402 of the solenoid bracket 114 via the brace plate 135.

Figure 3:
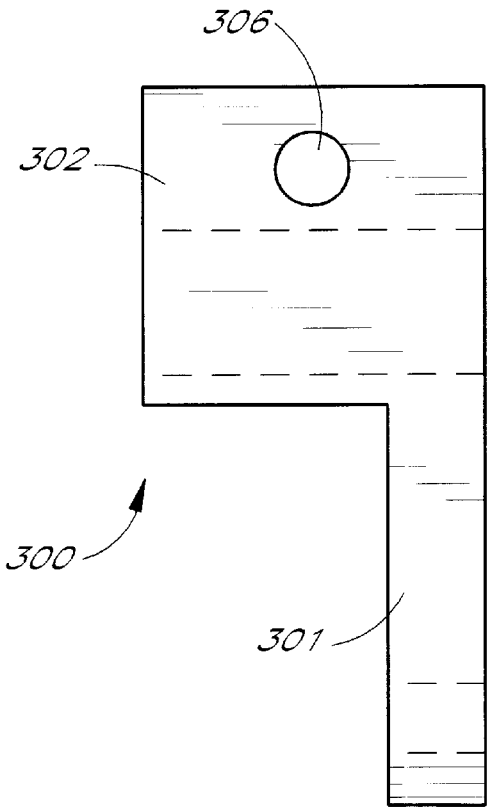
FIG. 3 depicts a side view of a lever adapter for the rear mounting embodiment of the present invention shown in FIG. 1.
Figure 4:
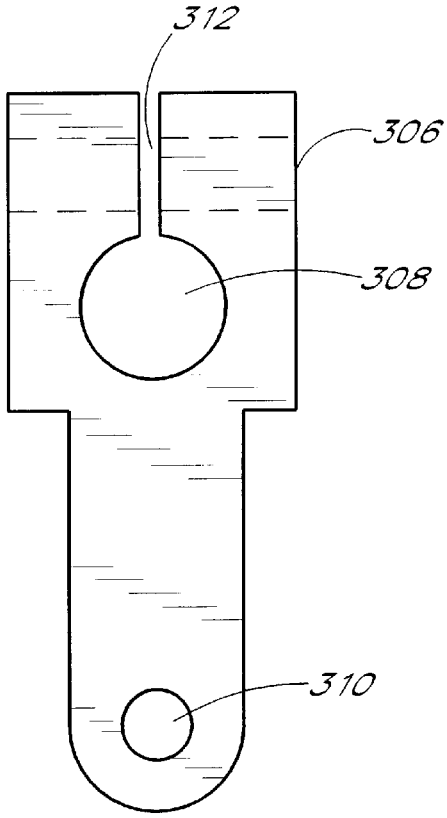
FIG. 4 depicts an end view of the lever adapter of FIG. 3.

Once the solenoid bracket 114 is mounted, the lever adapter 300 is mounted onto the control shaft extension 116. A detailed illustration of the adapter 300 from the side view and end view is shown in FIGS. 3 and 4, respectively. The lever adapter 300, shown in FIG. 3, has of a block portion 302 with an extension leg 301. The block portion 302 of the adapter contains a shaft bore 308 through which the adapter 300 is mounted onto the control shaft extension 116. Therefore, the diameter of the shaft bore 308 is similar in size to the diameter of the control shaft extension 116.

The FIG. 3 side view of the adapter 300 illustrates a clamp bore 306 on the block portion 302 of the adapter 300. In a preferred embodiment, the clamp bore 306 accommodates a tightening connector, such as a tightening bolt 307 (FIG. 2). Located on the adapter 300 just above the shaft bore 308 is a clamp slit 312 which allows the diameter of the shaft bore 308 to be adjusted with force exerted on the tightening bolt 307 of the adapter 300. The adapter 300 mounts onto the control shaft extension 116 and the tightening bolt 307 is inserted through the clamp bore 306. Tightening of the tightening bolt 307 causes the slit 312 to contract which clamps the adapter securely on the control shaft extension 116. Removal of the adapter 300 from the control shaft extension 116 is through loosening of the tightening bolt 307.

The leg extension 301 of the adapter 300 has an armature clip connection bore 310. An armature clip 126 (FIGS. 1 and 2*a*) of the solenoid 120 is attached to the extension leg 301 of the adapter 300. The armature clip 126 is fixed to the end of the armature 124 and connects the armature 124 of the solenoid to the lever adapter 300. The armature clip 126 is a fork-like extension with two arms 126*a*, 126*b* (FIG. 1) that are constructed to straddle the extension leg 301 of the adapter 300. Advantageously, a bushing 129 or the like is positioned between the arms 126*a*, 126*b* of the armature clip 126 with a fixing bolt 128 or the like, which passes through a bore through the center cylindrical axis of the bushing and through apertures in the armature clip arms 126*a*, 126*b*. The armature connection bore 310 (FIG. 4) through the adapter 300 is constructed such that the bushing 129 passes through the armature connection bore 310. In one advantageous embodiment, the bushing 129 is made from a metal, fiber or other composite material which provides for smooth pivot action between the armature connection bore 310 and the bushing 129. The armature clip 126 of the solenoid is in this manner rotatably fixed to the lever adapter 300 by inserting a connector 128, such as a bolt or a pivot pin or the like, through both the armature clip 126 and the armature connection bore 310 of the leg extension 301.

Advantageously, the extending end of the armature 124 is threaded externally to accept an internally threaded portion 127 of the armature clip 126. The threads allow for easy adjustment of the effective length of the armature 124 to properly position the connection between the armature 124 and the adapter 300. Advantageously, when the solenoid is not energized, the adapter leg extension 301 and the armature clip 126 form a 90 degree angle. Upon energization of the solenoid, the angle formed by the adapter leg extension 301 and the armature clip 126 may be greater than or less than 90 degrees depending on the direction of the current flowing in the solenoid coil. In other words, the armature 124 of the solenoid is energized to travel axially away from the cylindrical portion 122 of the solenoid or into the cylindrical portion 122 of the solenoid depending upon the flow of current. Accordingly, the solenoid is a bi-directional solenoid which allows the control switches 112 to be activated or deactivated thereby opening or closing a corresponding circuit breaker As depicted in FIG. 2, the solenoid 120 has a cylindrical portion 122 which houses a coil (not shown) and the armature 124 or output shaft of the solenoid. In the preferred embodiment, the solenoid 120 is manufactured by Lucas Control Systems Products of Vandalia, Ohio and operates on 24, 48, 120 or 220 volts AC or DC bi-directional, return to center solenoid. Electrical energy is required to move the armature 124 of the solenoid 120 to the extreme of either direction.

The cylindrical portion 122 of the solenoid is attached to a solenoid mounting plate 134 by bolts 130, 132. The solenoid mounting plate 134 is attached to the solenoid bracket 114 with a pivot 136. The pivot 136 is formed from a pivot sleeve 131 (FIGS. 1 and 2*b*) which is rigidly fixed to the solenoid mounting plate 134 and a pivot bolt 137 which passes through the pivot sleeve 131 and threads into the fixed sleeve portion 133 to affix the pivot sleeve 131 to the fixed sleeve portion 133 of the solenoid bracket 114. This connection allows for rotation of the solenoid about the pivot axis. Accordingly, the fixed sleeve portion 133 connected to the solenoid bracket 114 embraced with a brace plate 135 for rigidity forms a part of the pivot 136.

In an alternative embodiment, the pivot could be formed in a hinge fashion with two, three or more sleeve pieces with the brace plate 135 extending the length of the pivot with alternating sleeve portions connected to the brace plate 135 and the mounting plate 134.

The solenoid bracket 114, which is held in place with respect to the switch 112 by bolts 152 and 154, also supports a solenoid control panel 140. In the embodiment shown in FIG. 2, the solenoid control panel 140 is mounted on the upper portion 402 of the solenoid bracket 114.

The solenoid control panel 140 comprises a power signal line 148, a ground signal line 146, and trip and close signal lines 142 and 144, respectively. Signal lines 150 link the control panel 140 to the coil portion 122 of the solenoid. Control signals for the solenoid are provided by a control system 147 such as a computer or microcontroller based monitoring system with control outputs which are converted to analog signals sufficient to drive the control signals for the solenoid. Such a control system is shown and described in U.S. Pat. No. 5,179,376, assigned to the assignee of the present application, and incorporated herein by reference. Other control systems are also appropriate.

In the first embodiment of the present invention, the pistol grip 102 remains. Therefore, an operator can manually control the circuit breaker control switch 112 by rotating the pistol grip 102. Rotation of the pistol grip 102 rotates the control shaft 113, which operates the circuit breaker control switch 112.

For automatic control, when the control system 147 sends control signals to the switch actuator 100 of the present invention via control lines 149, the control panel 140 receives the signals. Signal lines 150 linking the control panel 140 to the solenoid 120 carry current to the solenoid coil to activate the solenoid 120. The signals on the open and close signal lines 142 and 144, respectively, control the direction of the flow of current through the solenoid 120. Depending on the direction of the current flowing through the coil, the armature 124 is either forced out of or drawn into the cylindrical portion 122 of the solenoid. Accordingly, the armature 124 and the armature clip 126 move along the axis of the solenoid 120.

Movement of the armature 124 causes the lever adapter 300 to rotate about an axis defined by the control switch extension shaft 116. Therefore, rotation of the adapter 300 rotates the control shaft extension 116 upon which the adapter 300 is mounted. The rotation of the control shaft extension 116 mechanically engages the control switch 112 for the circuit breaker control system. The circuit breaker control system thus reacts as if the pistol grip 102 had been manually operated.

FIGS. 7–12 depict a switch actuator made in accordance with a second embodiment of the present invention. In the second embodiment of the present invention, the switch actuator is front mounted onto an existing circuit breaker control switch 112.

Figure 7:
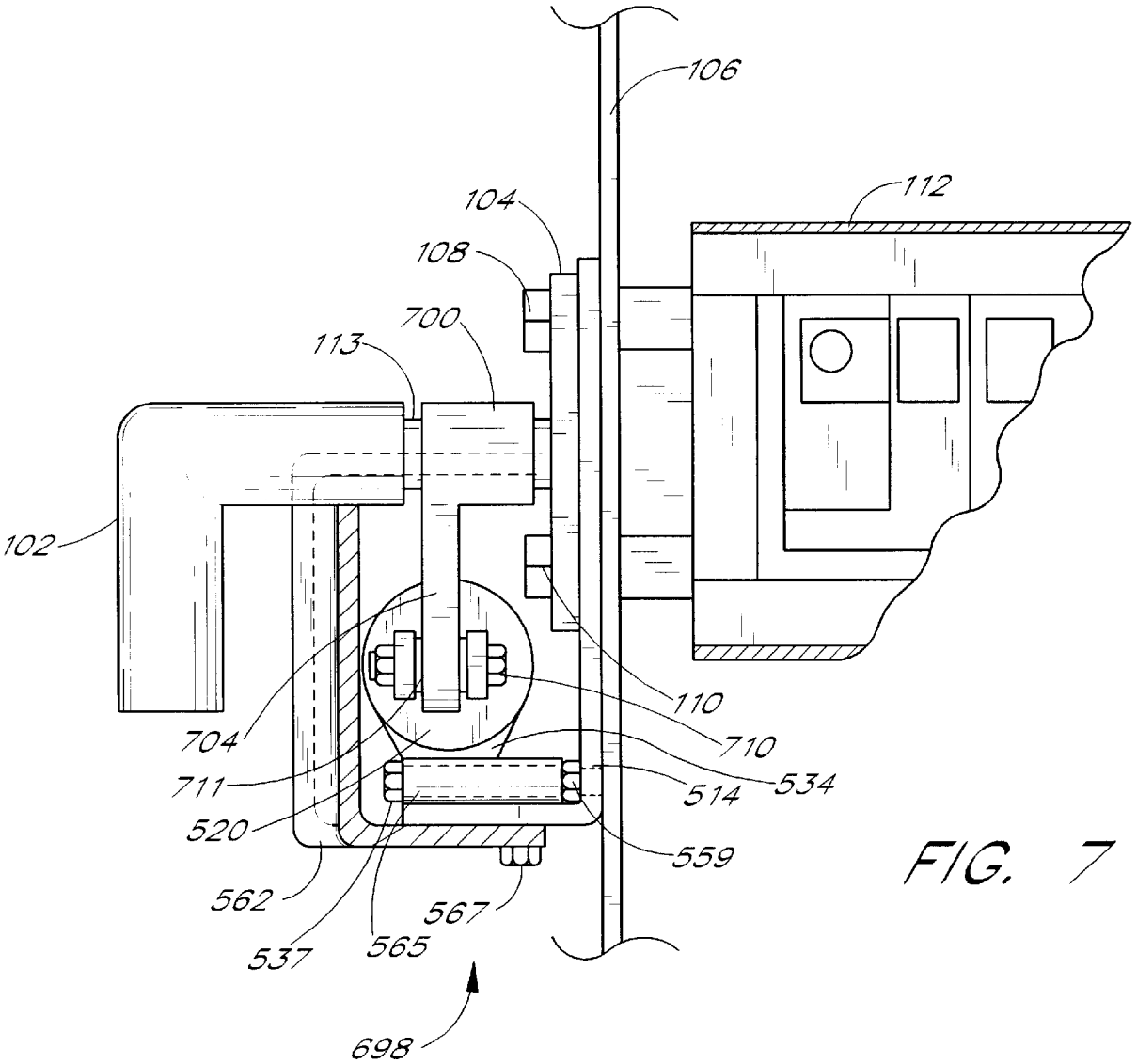
FIG. 7 depicts a side view of a switch actuator front mounted in accordance with a second embodiment of the present invention.

FIG. 7 illustrates a front mounted switch actuator 698 for automating the manual circuit breaker control switch 112. As depicted in FIG. 7, the pistol grip 102 is mounted to the control switch shaft 113. As in the previous embodiment, the control switch 112 has the mounting plate 104 and the mounting bolts 108, 110 which sandwich the control panel wall 106 between the mounting plate 104 and the control switch 112. In the embodiment of the present invention depicted in FIG. 7, an adapter 700 is provided for connection to a bidirectional solenoid 520. The solenoid 520 mounts to a solenoid bracket 514. A cover 562 for the solenoid 520 is also advantageous.

Figure 8:
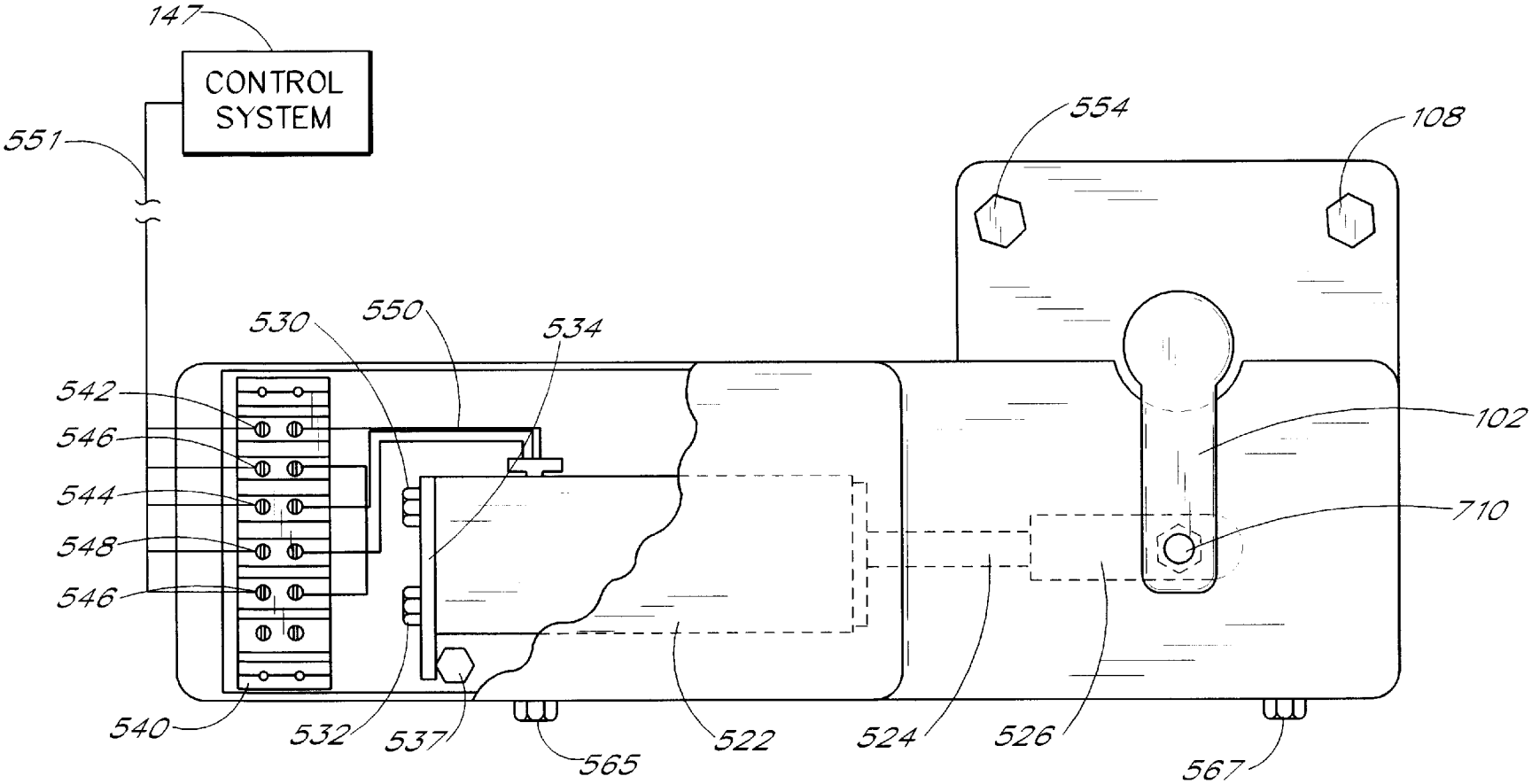
FIG. 8 is a rear view of the front mounted embodiment of the present invention shown in FIG. 7.
Figure 9:
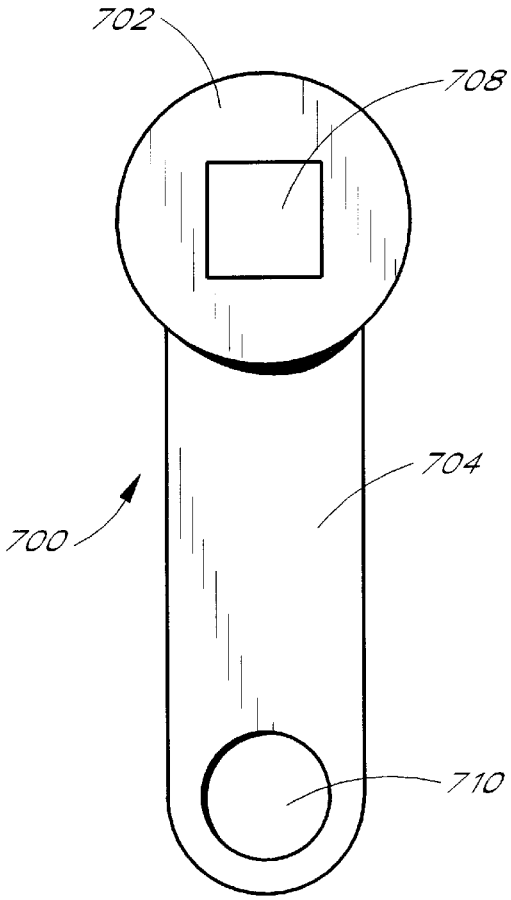
FIG. 9 depicts an adapter used in the front mounting embodiment of the present invention shown in FIG. 7.
Figure 10:
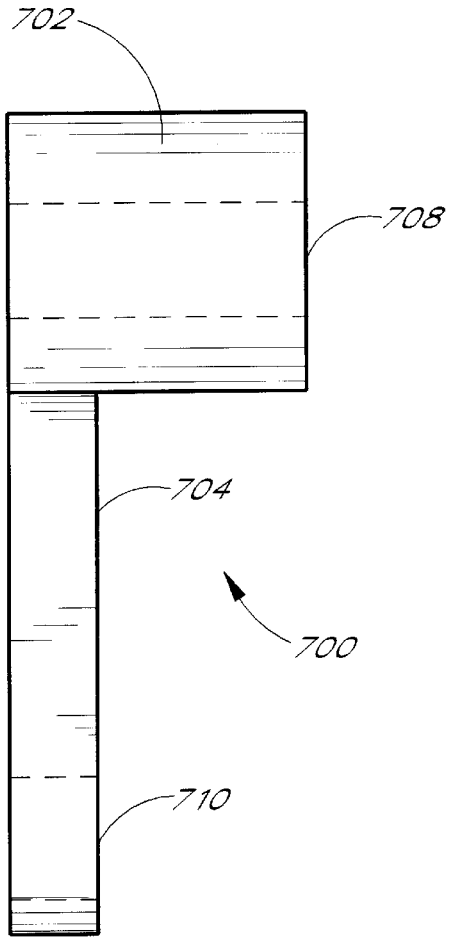
FIG. 10 depicts a side view of the adapter of FIG. 9.

FIG. 8 illustrates a side view of a switch actuator of the second embodiment of the present invention and will be discussed further below. FIG. 9 and 10 depict side and end views of the adaptor 700.

As illustrated in FIGS. 9 and 10, the adapter 700 comprises an upper block portion 702 with a lever arm 704. The block portion 702 of the adapter 700 is cylindrical in shape with a square through-hole 708 in the present embodiment. The square through-hole is sized to fit over the control shaft 113 without significant free-play. The lever arm 704 has a round armature clip connection through-hole 710 in the present embodiment. It should be understood that the square through-hole 708 is adapted for a square control switch shaft 113. However, the control switch shaft through-hole 708 will be other shapes for control shafts having other shapes.

Figure 12:
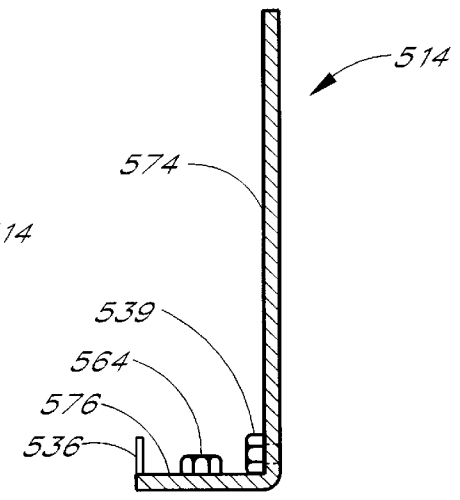
FIG. 12 is a cross-section of the solenoid bracket shown in FIG. 11.
Figure 11:
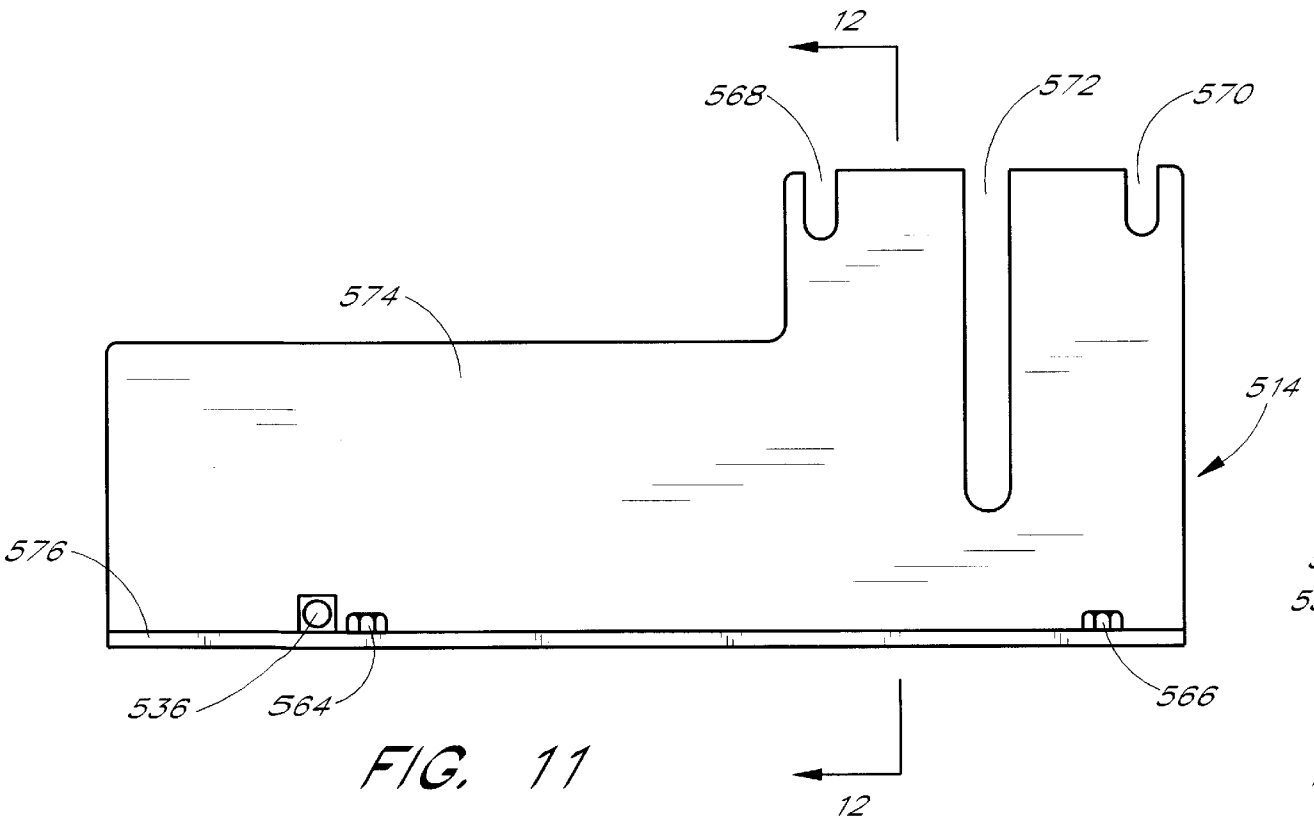
FIG. 11 depicts a front view of a solenoid bracket for front mounting the embodiment of the present invention depicted in FIG. 7.

FIGS. 11 and 12 depict a solenoid bracket 514 having an L-shaped cross-section, comprised of two sections, a mounting section 574 and a solenoid pivot section 576. The solenoid bracket 514 supports and protects the solenoid 520. The mounting portion 574 and the solenoid pivot portion 576 may be two pieces of material joined together or one continuous piece of material such as angle iron or a similar material as in the previous embodiment.

The mounting portion 574 of the solenoid bracket has mounting slots 568, 570, and an elongated switch shaft slot 572. These slots provide for ease of inserting the mounting portion 574 between the switch mounting plate 104 and the wall panel 106. The use of slots rather than holes avoids complete disassembly of the control switch mounting. However, in an alternative embodiment, holes could be used. The two short mounting slots 568 and 570 accommodate the switch bolts 108 and 554 (FIG. 8) that secure the solenoid bracket 514 to the wall panel 106. The number of slots on the solenoid bracket 514 varies according to the number of switch bolts used to secure the switch mounting plate 104 to the panel 106. The elongated slot 572 accommodates the control shaft 113 which protrudes from the wall panel 106 and a mounting bolt 110 (FIG. 7).

The solenoid bracket 514 also has cover nuts 564, 566 fixedly attached to the solenoid pivot portion 516 of the solenoid bracket 514 as depicted in FIG. 11. The cover bolt nuts are advantageously threaded inside and are positioned to align with apertures on the solenoid bracket pivot portion 576.

The solenoid bracket 514 also has a pivot 536 positioned along the pivot portion 576 of the solenoid bracket 514. In the present embodiment, the pivot 536 is made from a narrow flange with a through-hole sized to accept a pivot bolt 537 (FIG. 8). The pivot is also facilitated with a pivot nut 539 (FIG. 12) fixed to the solenoid bracket 514 as depicted in FIG. 12. The pivot nut 539 is adapted to receive the threads of the pivot bolt 537. An aperture through the pivot nut 539 aligns with an aperture through the pivot 536. In the present embodiment, the pivot nut 539 has internal threads.

Installation of the retrofit switch actuator is simple. First, the solenoid bracket 514 is attached to the wall panel 106 of the circuit breaker control system. The solenoid bracket 514 is installed by loosening the switch mounting bolts 108, 110, 554 (possible others not shown) to allow insertion of the mounting portion 574 of the solenoid bracket 514 between the wall panel 106 and the switch mounting plate 104. The elongated slot 572 and the shorter slots 568, 570 in the solenoid mounting bracket 514 are configured to accept the mounting bolts 110, 108, 554 and the control switch shaft 113 as the mounting portion 574 of the solenoid bracket 514 is slid between the mounting plate 104 and the wall panel 106. The mounting bolts 110, 108, 554 are then tightened to firmly secure the solenoid mounting plate 574 sandwiched between the switch mounting plate 104 and the wall panel 106.

The pistol grip 102 of the circuit breaker control switch 112 is temporarily removed from the control shaft 113 to allow the adapter 700 to be slid over the control shaft 113. In the present embodiment, the control switch shaft 113 is square. Accordingly, the square through-hole 708, depicted in FIG. 9, accepts the control switch 113. After the adapter 700 is positioned over the shaft 113, the pistol grip 102 is replaced upon the control shaft 113 distal of the adapter 700. The adapter 700 is positioned with the lever arm 704 directed toward the axis of the solenoid armature 524.

The solenoid has a mounting plate 534 which couples to the back of the solenoid via bolts 530, 532 as in the previous embodiment. The mounting plate has a pivot sleeve 565 aligned along an edge of the mounting plate 534, as illustrated in FIG. 7. The solenoid is positioned such that the sleeve 565 is aligned between the pivot flange 536 and the pivot nut 539. The pivot bolt 537 passes through the pivot flange 536, through the sleeve 565 and threads into the pivot nut 539. In one advantageous embodiment, nylon or other composite washers can be positioned between the pivot flange 536 and the pivot sleeve 565, and between the pivot nut 539 and the sleeve 565 to provide for easy rotation of the solenoid about the pivot point.

A solenoid armature clip 526, as in the previous embodiment, is then adjusted so that it aligns the lever arm 704. The solenoid clip 526 is connected to the lever arm 704 via a clip fixing bolt 710 and a bushing 711 with a bore through its center sized to receive the clip fixing bolt 710. The bushing is positioned between the arms of the armature clip 526 and through the through-hole 710 of the lever arm. Advantageously, this bushing is made of nylon or other low friction material such as graphite such that the lever arm 704 pivots at the through-hole 710 about the bushing 711. Other materials, such as metals, plastic and the like, are also suitable. This attachment is best shown in FIG. 7.

The pistol grip handle 102 is replaced such that the adapter 700 is mounted onto the control shaft 113 sandwiched between the pistol grip handle 102 and the switch mounting plate 104.

A switch actuator cover 562 is attached to the solenoid bracket 514. The cover protects both the solenoid 520 and its linkage to the circuit breaker control switch 112. The solenoid 520 is housed within the solenoid bracket 514 and cover 562. Cover bolts 566, 567 (FIG. 8) attach to the underside of the solenoid bracket 514 and secure the cover 562 to the solenoid bracket 514. Preferably, to allow hand clearance while turning the pistol grip 102, the cover 562 is recessed in the area of the pistol grip 102.

As illustrated in FIG. 8, a solenoid control panel 540 is mounted to the solenoid bracket 514. The solenoid control panel 540 is similar to the panel described in connection with the first embodiment of the present invention. The solenoid control panel 540 includes a power signal line 548, a ground signal line 546, and open and close signal lines 542, 544, respectively. Signal lines 550 link the solenoid control panel 540 to the cylindrical portion 522 of the solenoid that houses a coil (not shown). Signal lines 551 connect the control panel to the control system 147.

The switch actuator front mounted in accordance with a second embodiment of the present invention functions similarly to the rear mounted switch actuator. The present invention allows the remote actuation of the control switch from a main monitoring station. The control panel receives signals from the control system 147 and operates the solenoid consistently with the control signals. The solenoid causes the solenoid output shaft and the armature clip to move in either direction along its axis. The movement of the armature clip causes the adapter 700 to rotate about the axis of the shaft 113. The rotation of the control shaft 113 mechanically engages the control switch 112. A circuit breaker reacts to the control switch 112, just as if the pistol grip had been manually turned. In addition, the pistol grip handle 102 can still be used for manual actuation.

Figure 13:
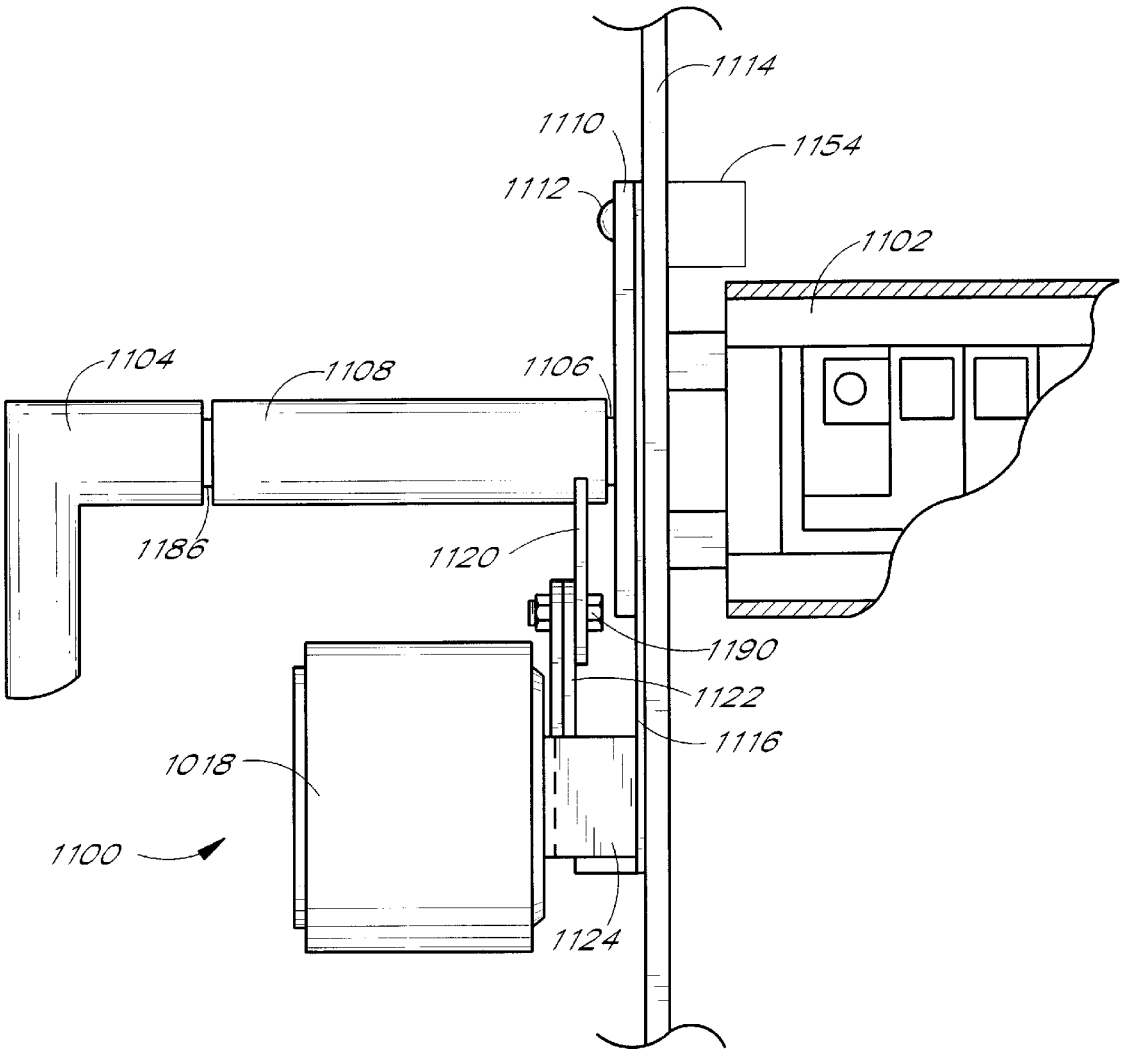
FIG. 13 depicts a side plan view of a retrofit switch actuator mounted to a control switch in accordance with an alternative embodiment of the present invention.

Occasionally, a power substation circuit breaker control panel contains multiple control switches grouped together in close proximity. When the control switches are grouped too close together, the previous embodiments of the retrofit switch actuator are too large to place on each control switch. In these cases, the additional, more compact, embodiment of the present invention as seen in FIG. 13 may be used. In FIG. 13, a retrofit switch actuator 1100 is installed on a circuit breaker control switch 1102. The circuit breaker control switch 1102 has a pistol grip 1104 mounted on a handle mounting shaft 1186 of an adapter 1108. The adapter 1108 is mounted on a control shaft 1106. A mounting plate 1110 holds the circuit breaker control switch 1102 to a control panel wall 1114. The retrofit switch actuator 1100 consists of several parts, including a link 1220, a solenoid bracket 1116, a solenoid 1118 and the adapter 1108 having a lower extension leg 1120. The retrofit switch actuator 1100 also includes a lever 1130, shown in FIG. 14*a*.

A plurality of mounting bolts 1112 pass through the mounting plate 1110 and sandwich the solenoid bracket 1116 between the control switch 1102 and the mounting plate 1110. Advantageously, the mounting bolts 1112 which attach the mounting plate 1110 to the control panel wall 1114 comprise threaded bolts, however, other methods of attachment can be used without altering the spirit of the invention. Preferably, the mounting bolts 1112 extend through the mounting plate 1110 and into the control panel wall 1114.

Figure 14A:
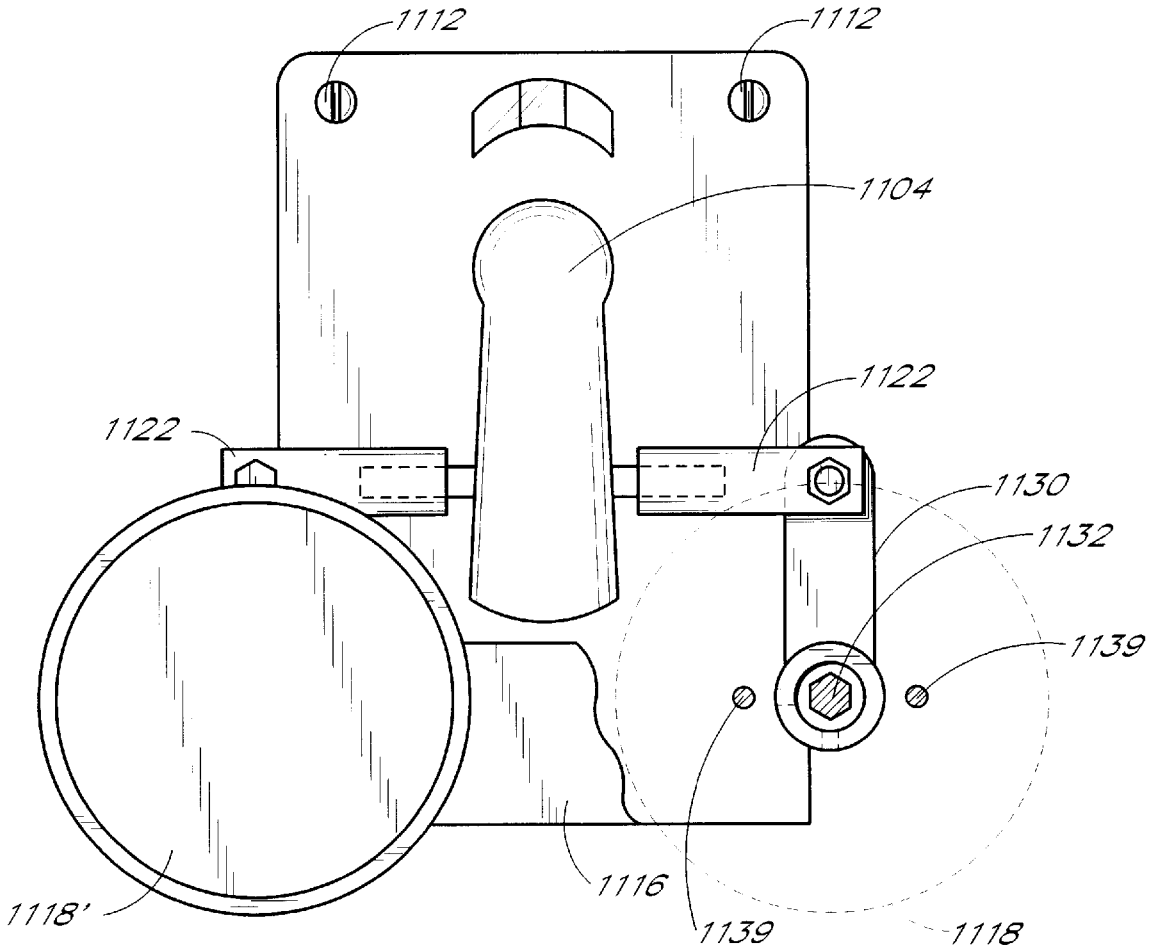
FIG. 14*a* is a partial cut-away front plan view of the actuator of FIG. 13.
Figure 14B:
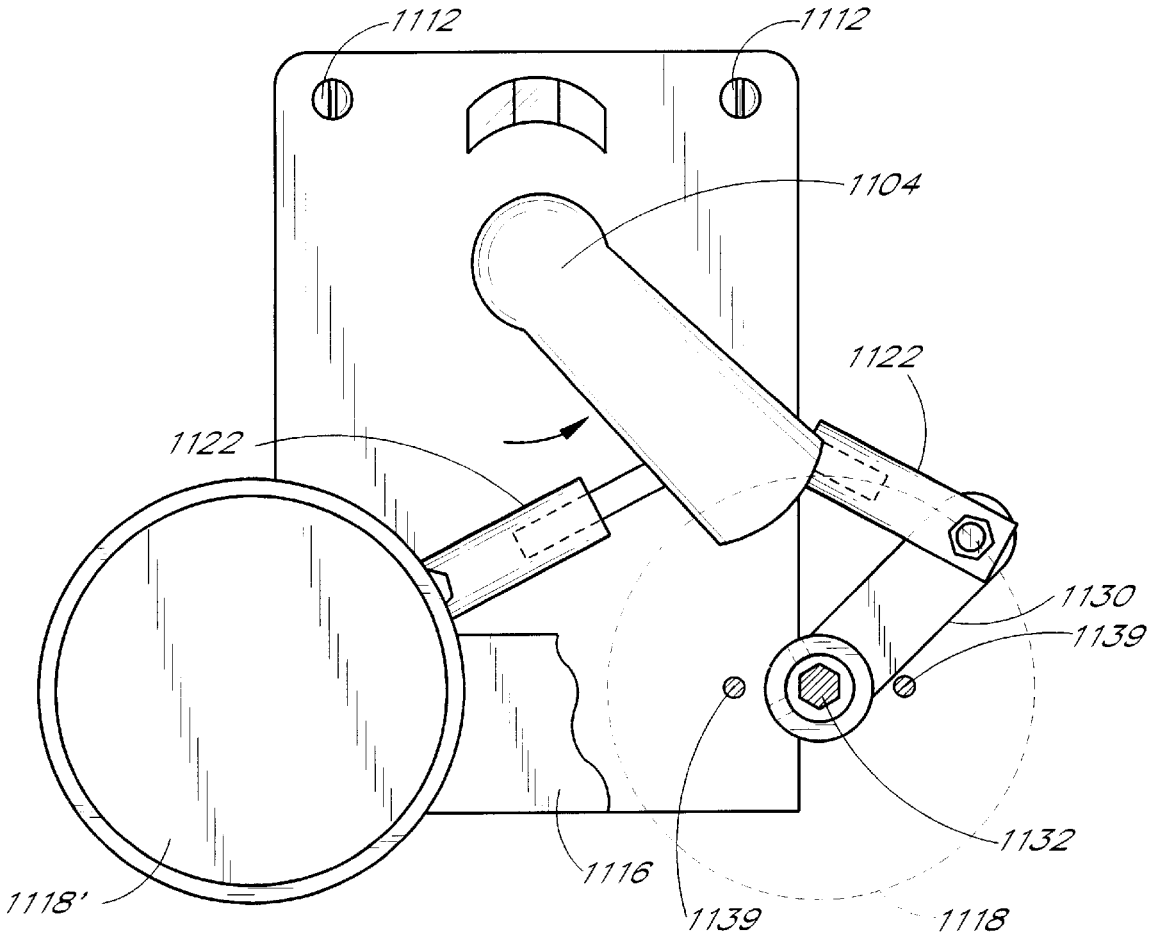
FIG. 14*b* is a partial cut-away front plan view of the actuator of FIG. 13 showing the switch having been moved to a first position.
Figure 14C:
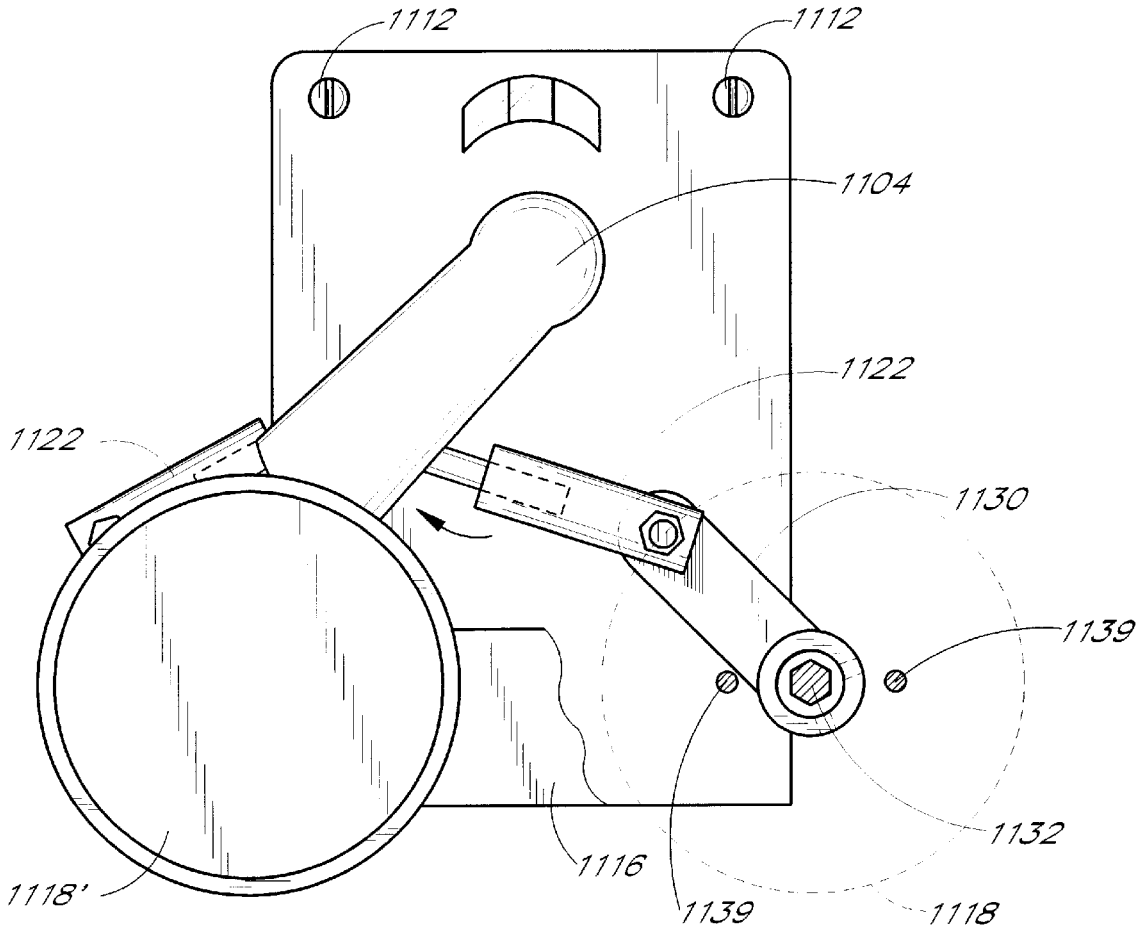
FIG. 14*c* is a partial cut-away front plan view of the actuator of FIG. 13 showing the switch having been moved to a second position.

The retrofit switch actuator 1100 is used for automatic actuation of the circuit breaker. Referring to FIGS. 14*a*–14*c*, when installed, the solenoids 1118 and 1118' are attached to the solenoid bracket 1116, as will be described below. The pistol grip 1104 has three positions—a neutral position shown in FIG. 14*a*, a reset position shown in FIG. 14*b*, and an off position shown in FIG. 14*c*. As described above, the pistol grip 1104 can be manually moved from the neutral position to either the reset position or the off position, as desired. The control shaft 1106 is spring loaded to automatically return to the neutral position. When the pistol grip 1104 is moved to either the reset position or the off position, the force of the spring loading returns the pistol grip 1104 to the neutral position. For automatic activation, each solenoid 1118 and 1118' is connected to the solenoid bracket 1116 via a pair of solenoid mounting bars 1139, as shown in the cut-away views. Preferably, the solenoid mounting bars 1139 are threaded to allow the solenoids 1118 and 1118' to be secured to the solenoid bracket 1116 with nuts (not shown). Of course, other techniques of securing the solenoids 1118 and 1118' to the solenoid bracket 1116 other than threaded solenoid mounting bars 1139 and nuts can be used without altering the spirit of the invention.

Figure 16:
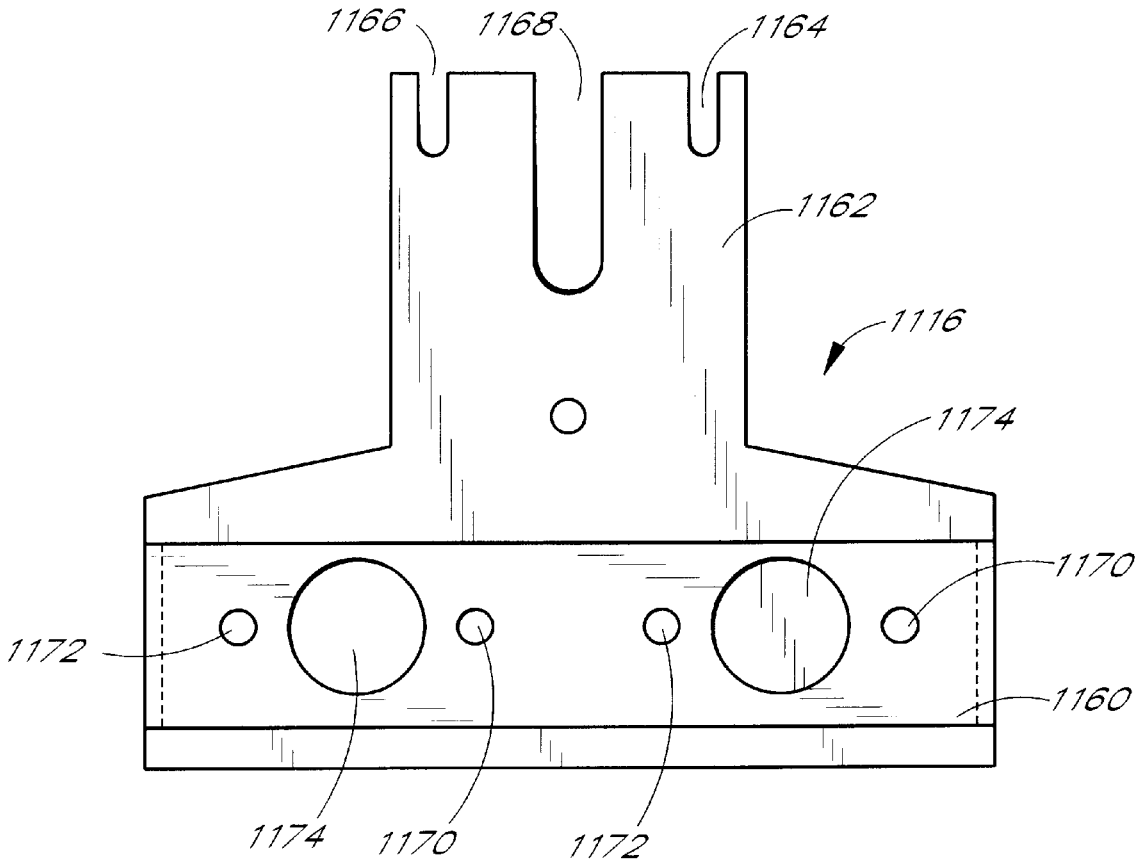
FIG. 16 is a front plan view of a solenoid bracket for use in accordance with a first embodiment of the present invention.

The solenoid bracket 1116 used to mount the retrofit switch actuator 1100 is illustrated in additional detail in FIG. 16. This bracket 1116 is easily formed from stock angle iron, angle aluminum, or other high strength composites. The solenoid bracket 1116 has a solenoid mounting section 1160 and a control panel mounting section 1162. In the control panel mounting section 1162, the solenoid bracket has mounting slots 1164, 1166, and an elongated switch shaft slot 1168. These slots provide for ease of inserting the control panel mounting section 1162 between the mounting plate 1110 and the control panel wall 1114. The use of slots rather than holes avoids complete disassembly of the control switch mounting. However, in an alternate embodiment, holes could be used. The two mounting slots 1164 and 1168 accommodate the mounting bolts 1112 (see FIGS. 13 and 14) that secure the solenoid bracket 1116 to the control panel wall 1114. The number of slots on the solenoid bracket 1116 can vary according to the number of mounting bolts 1112 used to secure the mounting plate 1110 to the control panel wall 1114. The elongated switch shaft slot 1168 accommodates the control shaft 1106, which protrudes from the control panel wall 1114.

The solenoid mounting section 1160 is spaced parallel to the control panel mounting section 1162 via the side panels 1124 (FIG. 13). The solenoid mounting section 1160 contains both the solenoid mounting holes 1170 and 1172 and a solenoid access hole 1174 for each solenoid to be attached to the solenoid bracket 1116. As described above, the solenoid 1118 includes the solenoid mounting bars 1139. During installation, the mounting bars 1139 are inserted through the solenoid mounting holes 1170 and 1172 of the solenoid mounting section 1160. The solenoid shaft 1132 (FIG. 14*a*) of the solenoid 1118 extends through the solenoid access hole 1174. As described above, the solenoid 1118 is secured to the solenoid mounting section 1160 by threading securing nuts (not shown) over the mounting bars 1139.

Installation of the retrofit switch actuator 1100 is simple. First, the solenoid bracket 1116 is attached to the control panel wall 1114 of the circuit breaker control system. The solenoid bracket 1116 is installed by loosening the mounting bolts 1112 to allow insertion of the control panel mounting section 1162 of the solenoid bracket 1116 between the control panel wall 1114 and the mounting plate 1110. The elongated switch shaft slot 1168 and the shorter slots 1164, 1166 of the solenoid mounting bracket 1116, are configured to accept the mounting bolts 1112 and the control shaft 1106 as the control panel mounting section 1162 of the solenoid bracket 1116 is slid between the mounting plate 1110 and the control panel wall 1114. The mounting bolts 1112 are then tightened to firmly secure the solenoid bracket 1116 sandwiched between the mounting plate 1110 and the control panel wall 1114.

Figure 17:
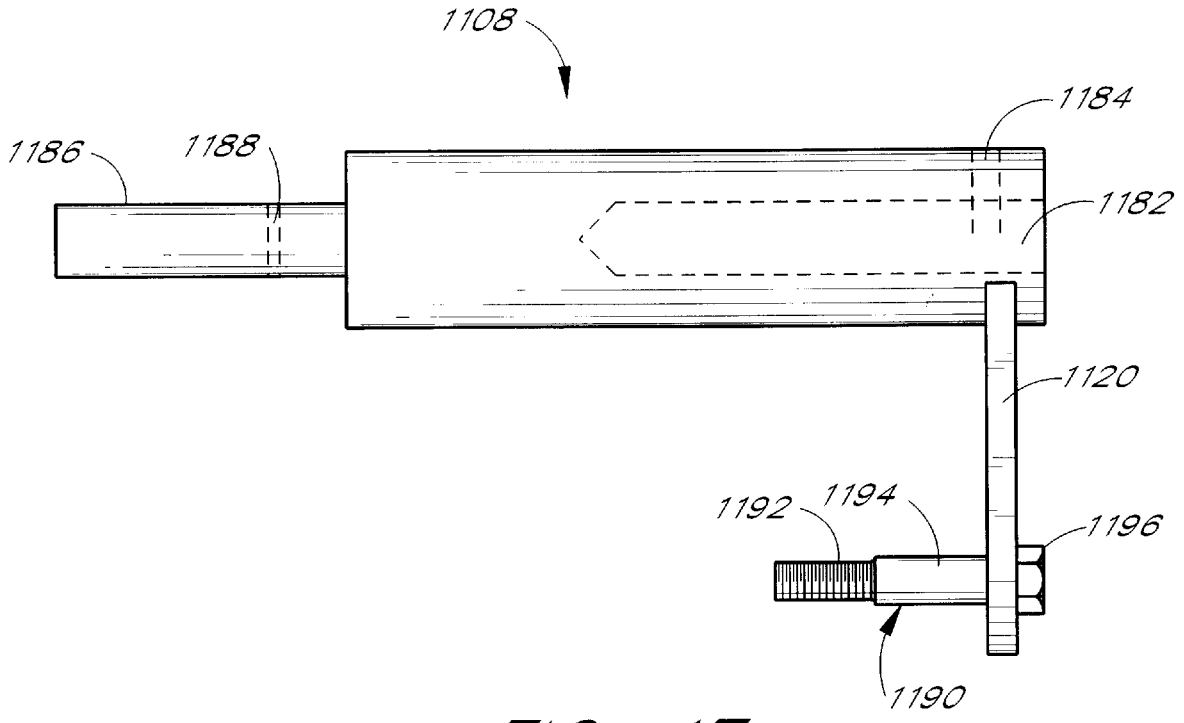
FIG. 17 is a side plan view of an adapter for use in accordance with a first embodiment of the present invention.
Figure 18:
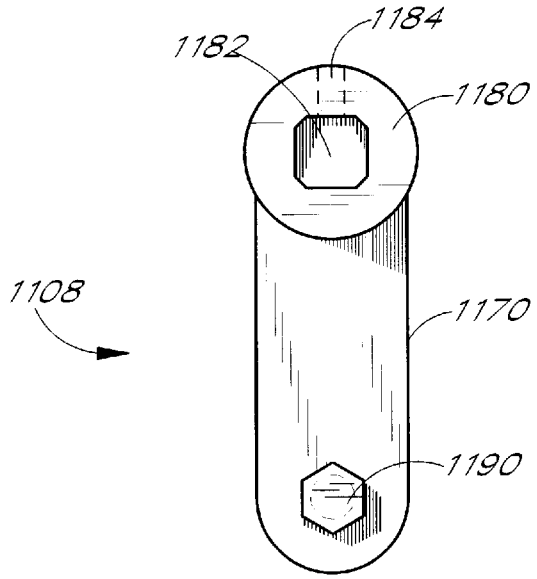
FIG. 18 is a rear plan view of the adapter of FIG. 17.

The pistol grip 1104 of the circuit breaker control switch 1102 is temporarily removed from the control shaft 1106 to allow the adapter 1108 to be slid over the control shaft 1106. In the present embodiment, the control shaft 1106 is substantially square. Accordingly, a substantially square connector hole 1182, shown in FIGS. 17 and 18, accepts the control shaft 1106. As seen in FIG. 17, the adapter 1108 also has a set screw hole 1184 to allow a set screw (not shown) to secure the adapter 1108 to the control shaft 1106. The adapter 1108 also contains the handle mounting shaft 1186 extending from an upper block portion 1180 of the adapter 1108. After the adapter 1108 is positioned over the control shaft 1106, the pistol grip 1104 is placed on the handle mounting shaft 1186 of the adapter 1108. The handle mounting shaft 1186 also has a set screw hole 1188 to allow a set screw (not shown) to secure the pistol grip 1104 to the handle mounting shaft 1186.

When the pistol grip 1104 is mounted on the handle mounting shaft 1186, any rotation of the adapter 1108 also rotates the pistol grip 1104, and consequently, any rotation of the pistol grip 1104 also rotates the adapter 1108. This allows manual operation of the pistol grip 1104 even with the retrofit switch actuator 1100 attached to the circuit breaker control switch 1102. Rotation of the pistol grip 1104 manually will, in turn, rotate the adapter 1108, which rotates the control shaft 1106, thereby operating the circuit breaker control switch 1102.

Referring to FIGS. 13 and 17, attached to the lower extension leg 1120 of the adapter 1108 is a link mounting bolt 1190. The link mounting bolt 1190 has a threaded section 1192 and a smooth shaft section 1194. In the preferred embodiment, a bolthead 1196 of the link mounting bolt 1190 is welded to the lower extension arm 1120. However, any method of securing the link mounting bolt 1190 to the lower extension arm 1120 can be used.

The combination of the adapter 1108, the link 1220, and the lever 1130 transfer the rotational movement of the solenoid shaft 1132 to the control shaft 1106. The interplay of these components will now be described with reference to FIGS. 17–21.

Figure 19:
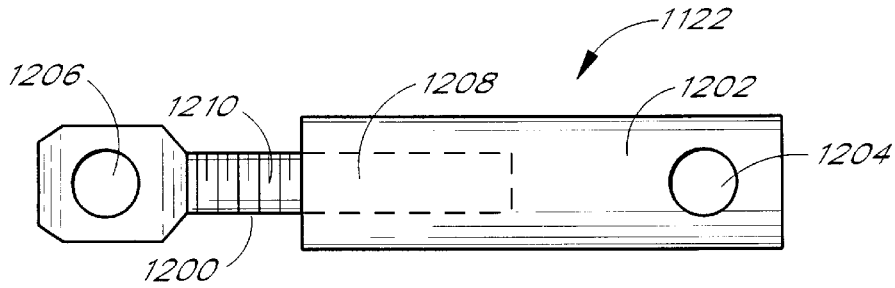
FIG. 19 is a side plan view of a link for use in accordance with the embodiment of the present invention as shown in FIG. 13.

The link 1220 as shown in FIG. 19 has an adapter connector hole 1222 and an extended lever connector 1226. To attach the link 1220 to the adapter, the link mounting bolt 1190 of the adapter 1108 is inserted through the adapter connector hole 1222 of the link 1220. The link 1220 connects to the lever 1130 by inserting a mounting bolt 1238 of the lever 1130 through the extended lever connector 1226. At rest, the mounting bolt 1238 sits at a first end 1227 of the extended lever connector 1226. When the solenoid shaft 1132 rotates, the lever 1130 is moved. The mounting bolt 1238 can travel from the first end 1227 to a second end 1228 of the extended lever connector before moving the link 1220. This allows some rotation of the solenoid shaft 1132 without movement of the control shaft 1106. In the preferred embodiment, the solenoid shaft 1132 rotates approximately 45 degrees during the movement of the mounting bolt 1238 from the first end 1227 to the second end 1228 of the extended lever connector 1226. Because of this, approximately 90 degrees of rotation by the solenoid shaft 1132 only rotates the control shaft 1132 approximately 45 degrees. A second link 1220 (FIG. 14*a*) is inserted onto the link mounting bolt 1190 to attach to the second solenoid 1118'. When both links 1220 are positioned over the link mounting bolt 1190, a nut (not shown) is placed over the threaded section 1192 of the link mounting bolt 1190 to secure the links 1220 to the link mounting bolt 1190.

Figure 20:
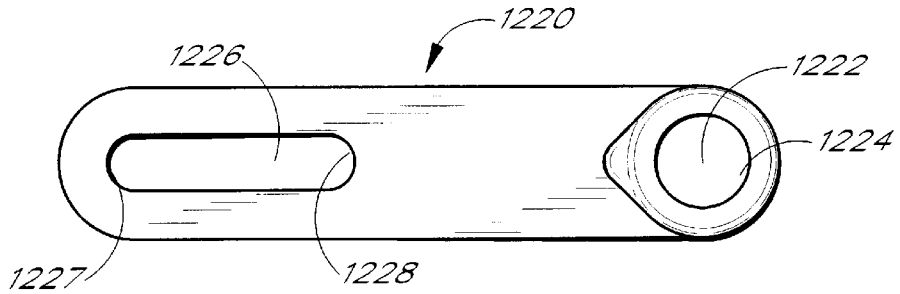
FIG. 20 is a side plan view of a lever for use in accordance with the embodiment of the present invention as shown in FIG. 13.
Figure 21:
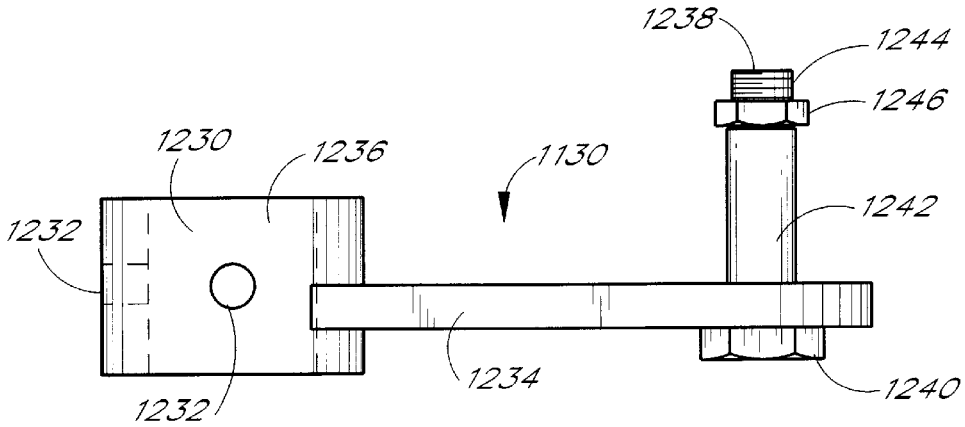
FIG. 21 is a front plan view of the lever in FIG. 20.

The lever 1130, shown in FIGS. 20 and 21, consists of an upper block portion 1230 and an extension portion 1234. The upper block portion 1230 contains a through-hole 1236 for connection to the solenoid shaft 1132. To connect the lever 1130 to the solenoid 1118, the through-hole 1236 is placed over the solenoid shaft 1132. Set screw holes 1232 are placed in the upper block portion 1230 to allow set screws to firmly attach the lever 1130 to the solenoid shaft 1132. Although the lever 1130 of the preferred embodiment contains a round through-hole 1236, any shape through-hole can be used to match the shape of the solenoid shaft 1132.

Referring to FIG. 13, the circuit breaker control switch 1102 controls a power substation circuit breaker (not shown). Rotation of the control shaft 1106 triggers the circuit breaker control switch 1102 of the circuit breaker. Once activated, the circuit breaker control switch 1102 signals switching mechanisms within the circuit which ultimately open or close the circuit breaker.

Each solenoid 1118 and 1118' as shown in FIGS. 14*a*–14*c* contains a solenoid shaft 1132. Preferably, the solenoids 1118 and 1118' produce a rotary movement of their respective solenoid shaft 1132. The solenoids 1118 and 1118' are standard rotary solenoids, such as those manufactured by Lucas Control System Products of Vandalia, Ohio. The first solenoid 1118 produces a counter-clockwise rotation of the solenoid shaft 1132. This rotation, shown in FIG. 14*c*, is transferred to the control shaft 1106 so that the pistol grip 1104 moves from the neutral position to the off position. In a similar manner shown in FIG. 14*b*, the second solenoid 1118' produces a clockwise rotation of its solenoid shaft (not shown) so as to rotate the control shaft 1106 to move the pistol grip 1104 from the neutral position to the reset position.

The rotary movement of the solenoids 1118 and 1118' is transferred from the solenoid shaft 1132 to the control shaft 1106 through a connecting mechanism. The connecting mechanism consists of the link 1220, the lever 1130, and the adapter 1108. The lever 1130 connects the solenoid shaft 1132 to the link 1220. The link 1220 connects to the lower extension leg 1120 of the adapter 1108. As described above, the adapter 1108 mounts over the control shaft 1106, thereby transferring movement of the adapter 1108 to the control shaft 1106. All rotation of the control shaft 1106 caused by rotation of the first solenoid 1118 is absorbed by the extended lever connector 1226 of the opposite link 1220, thereby preventing rotation of the opposite solenoid 1118'.

Figure 15:
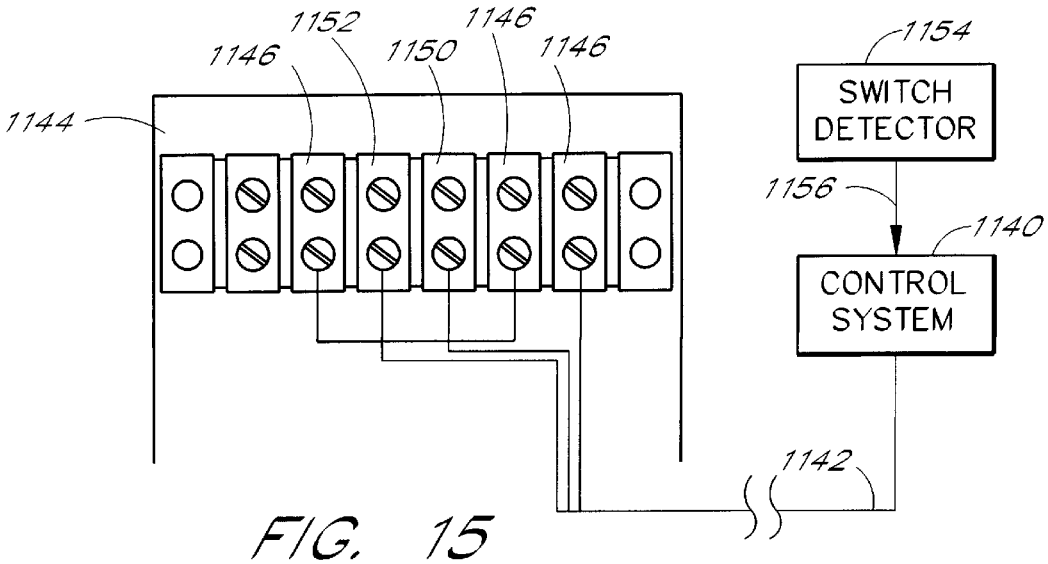
FIG. 15 is a front plan view of control panel for use with the present invention.

For automatic control, a control system 1140 as seen in FIG. 15 sends control signals to the retrofit switch actuator 1100 of the present invention via control lines 1142 to a control panel 1144 which receives the signals. Preferably, the control panel 1144 is mounted to a side panel 1124 (FIG. 13) of the solenoid bracket 1116. Each solenoid 1118 and 1118' has a separate control panel 1144. Signal lines (not shown) link the control panel 1144 to the solenoid 1118 to carry current to the solenoid coil to activate the solenoid 1118. In operation, the control panel 1144 receives the control signals from the control system 1140 via the signal lines 1142. The control panel 1144 contains an open signal line 1148, a ground signal line 1146, a closed signal line 1150, and a power signal line 1152. When the proper signals are received from the control panel 1144, the solenoid 1118 or 1118' is activated, and the solenoid shaft 1132 thereby rotated. A switch detector 1154 determines if the control switch 1102 was actually activated and then transmits the information in a signal to the control system 1140 along a signal line 1156. If the control switch 1102 was activated, the control system 1140 turns off. Otherwise, the control system 1140 sends another signal to reactivate the solenoid 1118 or 1118' until the control switch is activated. In the preferred embodiment, the switch detector 1154 comprises a potentiometer mounted on the rear of the control panel wall 1114 as seen in FIG. 13.

In automatic operation, and with reference to FIG. 14*a* through FIG. 15, the solenoid 1118 receives a signal from the solenoid control panel 1144. The solenoid 1118 rotates the solenoid shaft 1132 counter-clockwise. This counter-clockwise rotation of the solenoid shaft pivots the lever 1130. The pivoting lever 1130 forces the link 1220 to move to the left. The leftward movement of the link 1220 is transferred to the adapter 1108 through the lower extension arm 1120 into rotational movement. This rotational movement of the adapter 1108 rotates the control shaft 1106, thereby moving the pistol grip 1104 from the neutral position to the off position. Of course, use of solenoid 1118' causes the movement of the pistol grip 1104 from the neutral position to the reset position.

Figure 14D:
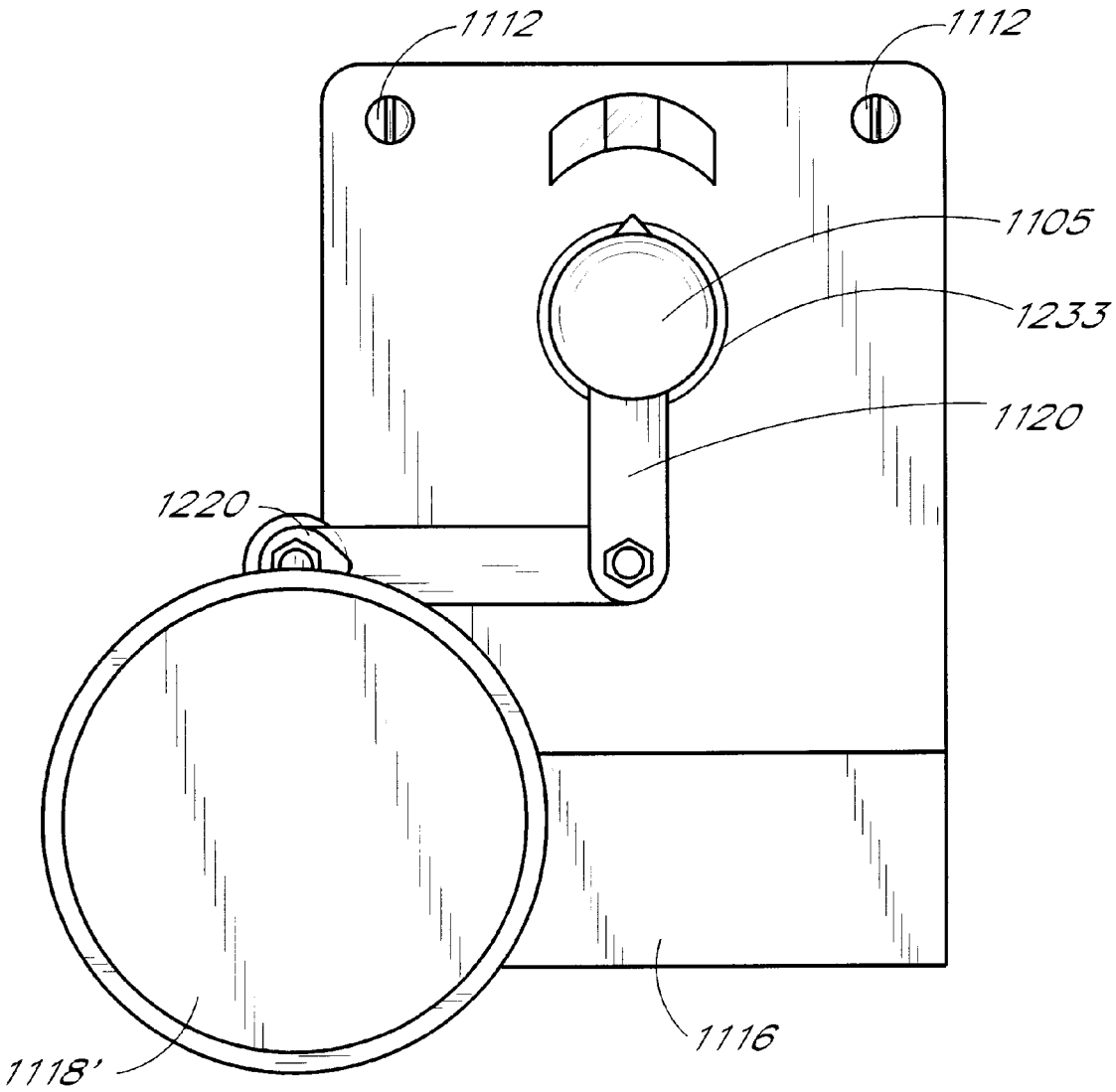
FIG. 14*d* depicts a front plan view of a retrofit switch actuator mounted to a control switch in accordance with an alternate embodiment of the present invention.

For multi-position control switches, the embodiment of the present invention using a single rotary solenoid 1118' as shown in FIG. 14*d* may be used. This embodiment incorporates the use of a roller clutch 1233. The clutch 1233 is a unidirectional drive roller clutch, such as a unidirectional drive roller clutch sold by Sterling Instruments Incorporated. The clutch 1233 connects a turn knob 1105 to the handle mounting shaft 1186 of the adapter 1108 (FIG. 17). This embodiment for activating multi-position control switches is similar to the dual-solenoid embodiment described above except the turn knob 1105 and the roller clutch 1233 replace the pistol grip 1104, and the extended lever connector 1226 of the link 1220 is replaced with a simple link connector hole (not shown). Of course, for the embodiment shown in FIG. 14*d*, only a single solenoid 1118' is used. When the solenoid 1118' is activated, the rotational movement of the solenoid shaft 1132 (FIG. 14*b*) is transferred along the linkage mechanism to move the lower extension arm 1120 as described above in reference to FIGS. 14*a*–14*c*. The movement of the lower extension arm 1120 results in rotation of the turn knob 1105. The clutch 1233 transfers movement of the lower extension arm 1120 in one direction, but ratchets during movement of the lower extension arm 1120 in the opposite direction. Therefore, when the solenoid shaft 1132 resets, the clutch 1233 will prevent the turn knob 1105 from returning to the original position. The use of a clutch 1233 allows the turn knob 1105 to rotate through all 360° with multiple solenoid 1118' activations without any movement in the opposite direction.

Figure 22:
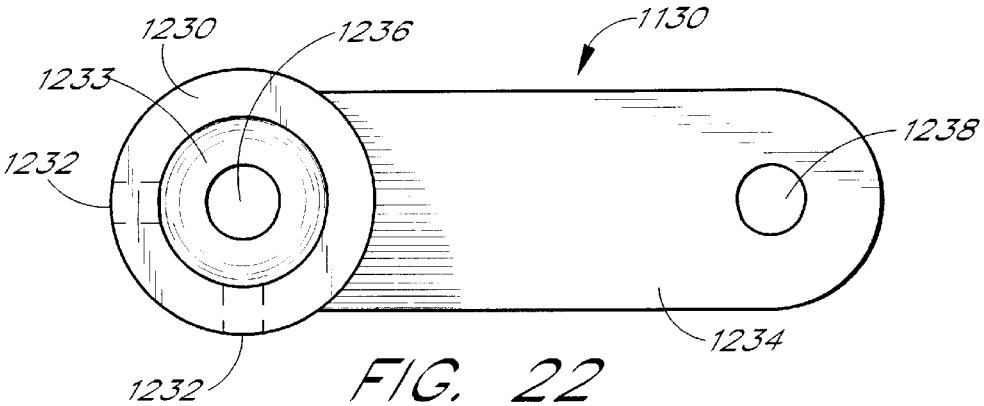
FIG. 22 depicts a side plan view of a retrofit switch actuator mounted to a control switch in accordance with an additional embodiment of the present invention.

When even less space is available to mount the switch actuator, the alternate embodiment of the present invention shown in FIG. 22 may be used. Although this embodiment occupies less space than the previous embodiments, it is also the most expensive. In this embodiment, a dual solenoid 1250 is connected to the circuit breaker control switch 1102 via a dual shaft adapter 1260. The dual solenoid 1250 is comprised of a first coil 1252 and a second coil 1254. The coils 1252, 1254 rotate a dual solenoid shaft 1264 having a first end 1256 and a second end 1258. The first coil 1252 rotates the solenoid shaft 1264 in a clockwise direction. The second coil 1254 rotates the solenoid shaft 1256 in an opposite, or counterclockwise direction. Of course, the first coil 1252 could rotate the solenoid shaft 1264 in a counterclockwise direction and, in which case, the second coil 1254 would then rotate the solenoid shaft in a clockwise direction.

The dual solenoid 1250 is attached to the circuit breaker control switch 1102 via the dual-shaft adapter 1260. The dual-shaft adapter 1260 has a first adapter hole 1266 and a second adapter hole 1268 at opposite ends of the adapter 1260. The first adapter hole 1266 is designed to be placed over the control shaft 1106. The second adapter hole 1268 is designed to be placed over the first end 1256 of the dual solenoid shaft 1264. The first adapter hole 1256 and the second adapter hole 1268 may be any shape to accommodate different shapes of the control shaft 1106 or the solenoid shaft 1264 without altering the spirit of the invention. When the dual shaft adapter 1260 is in place, rotation of the dual-solenoid shaft 1264 is transferred through the dual-shaft adapter 1260 to rotate the control shaft 1106. A dual solenoid bracket 1262 provides stability of the dual solenoid 1250 during operation.

As can be appreciated, the combination of the first coil 1252 and the second coil 1254 of the dual solenoid 1250 is capable of rotating the solenoid shaft 1264 in either a clockwise or counterclockwise direction. This allows automatic operation of the circuit breaker control switch 1102 by rotating the control shaft 1106 in either direction. The dual solenoid 1250 is controlled remotely via a control system 1140 and a solenoid control panel 1144 as shown and described above in FIG. 15.

Installation of the dual solenoid 1250 is simple. First, the pistol grip 1104 is removed from the control shaft 1106. The dual solenoid bracket 1262 contains a control panel mounting section 1269 identical to the control panel mounting section 1162 of the solenoid bracket 1116 shown in FIG. 16. The dual solenoid bracket 1262 in this embodiment of the present invention is installed identically to the solenoid bracket 1116 of the previous embodiment of the present invention by sandwiching the dual solenoid bracket 1262 between the mounting plate 1110 and the control panel wall 1114 and then securing in place by tightening the mounting bolts 1112. The dual shaft adapter 1260 is then placed over the control shaft 1106. The first end 1256 of the dual solenoid shaft 1264 is then inserted in the second square adapter hole 1268 of the dual-shaft adapter 1260. The dual solenoid 1250 is then secured to the dual-solenoid bracket 1262 by means of connecting post and nuts (not shown) in a manner similar to the method described above. The pistol grip 1104 is then placed upon the second end 1258 of the dual solenoid shaft 1264.

Figure 23:
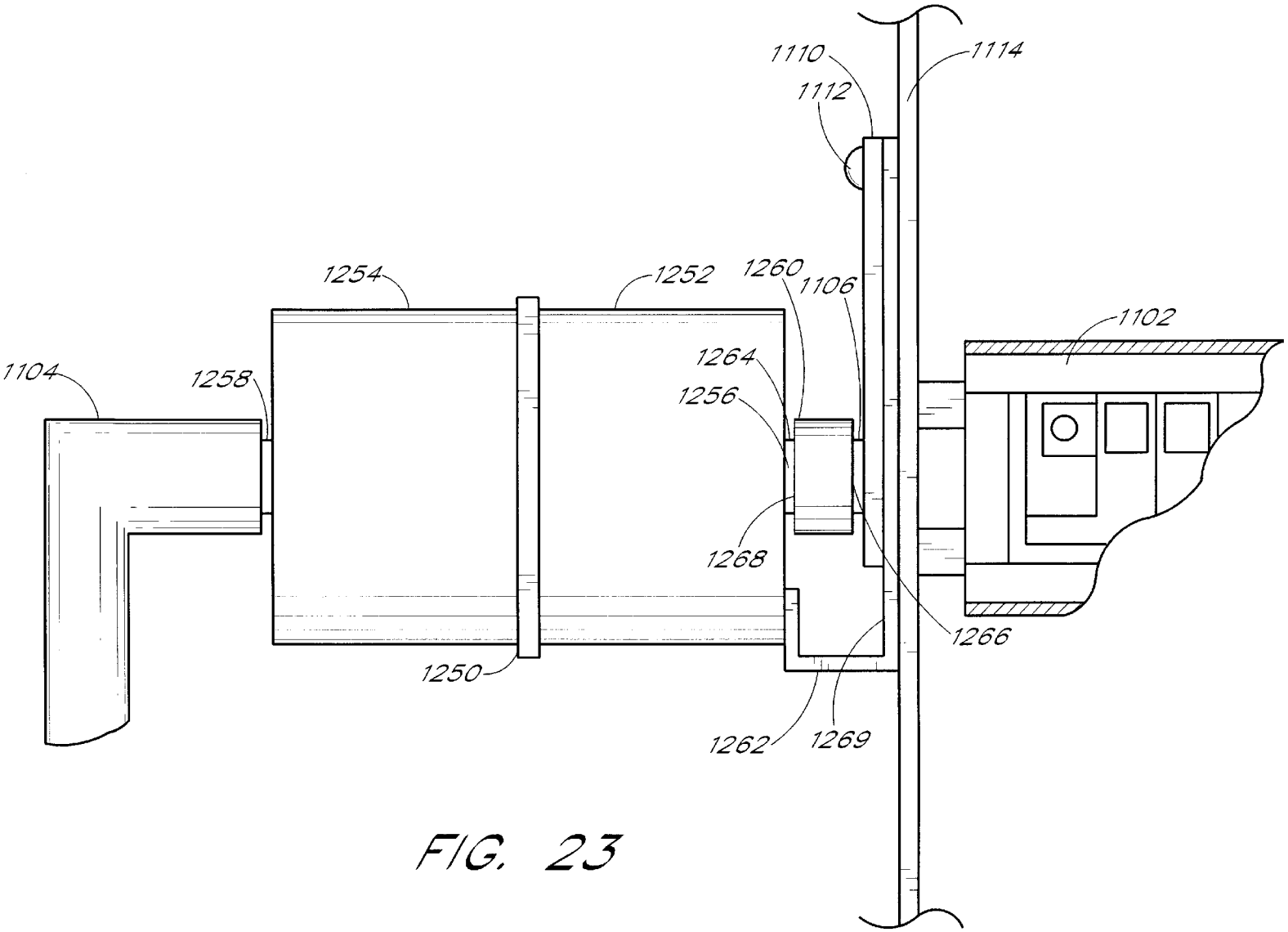
FIG. 23 is a front plan view of the actuator of FIG. 22.
Figure 24:
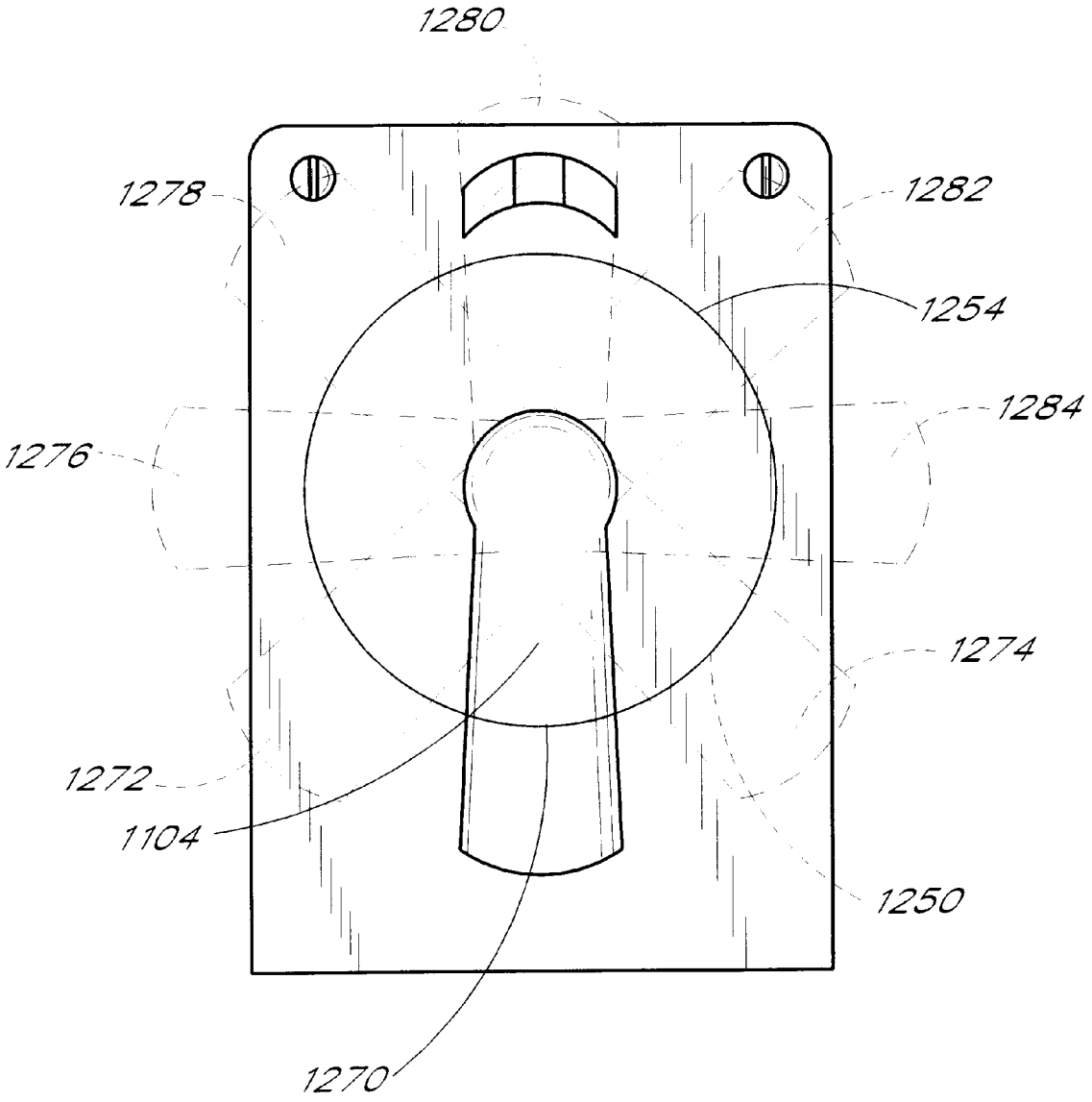
FIG. 24 depicts another view of the actuator of FIG. 22.
Figure 25:
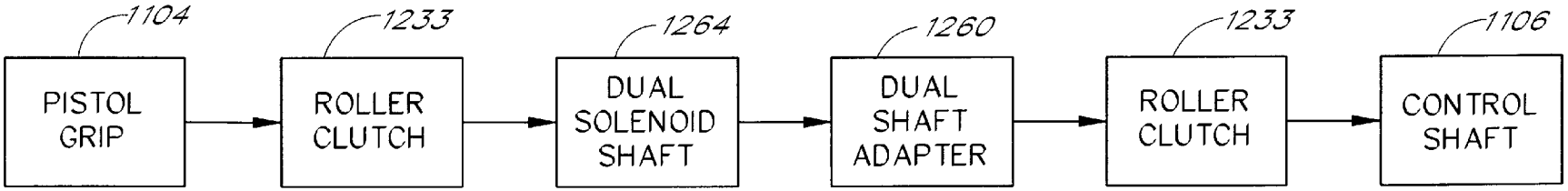
FIG. 25 depicts a flow chart of the actuator.

For manual operation, the pistol grip 1104 can be rotated in either direction. This rotation of the pistol grip 1104 rotates the dual-solenoid shaft 1264 and thereby, through the dual-shaft adapter 1260, the control shaft 1106 is rotated. Originally, the pistol grip 1104 begins in a first position 1272 as seen in FIG. 23. Through either manual rotation of the pistol grip 1104 or through automatic operation of the dual solenoid 1250, the pistol grip 1104 may be moved from the first position 1270 to a second position 1274 shown in phantom in FIG. 23. Similarly, the handle could then be moved from the second position 1274 back to the first position 1272. By using the dual solenoid 1250, the present invention can be used on two-position circuit control switches when space is limited.

Numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A switch actuator for a circuit breaker control switch, said circuit breaker control switch having a rotatable control switch output shaft, said switch actuator comprising:

a solenoid having an axially movable output shaft; and an adapter coupled to said axially movable output shaft and adapted to be coupled to said control switch output shaft, said adaptor converting axial movement by the axially movable output shaft into rotational motion which turns the control switch output shaft about an axis of rotation of the control switch output shaft without any lateral movement of the control switch output shaft.

2. A switch actuator for a circuit breaker control switch, said circuit breaker control switch having a rotatable control shaft, said switch actuator comprising:

a solenoid having an axially movable output shaft; and an adapter rotatably mounted on one end to the axially movable output shaft of said solenoid and adapted to be fixedly mounted on the other end to said rotatable control shaft such that the adapter converts axial movement of said solenoid output shaft into rotational motion of the control shaft without any lateral movement of the control shaft.

3. The switch actuator of claim 1, wherein said adapter comprises an upper block portion adapted to be mounted to said control shaft and a lower extension leg.

4. The switch actuator of claim 3, wherein said adapter further comprises:

a first opening, the size of said opening large enough to accommodate the control shaft of said circuit breaker control switch; and a second opening oriented parallel to said first opening, said second opening providing for attachment between said adapter and said solenoid.

5. The switch actuator of claim 4, wherein said adapter further comprises:

a cylindrical opening on said adapter through which a tightening connector can be inserted; and a slit located along a cross-section of said cylindrical opening, said slit configured to contract with force exerted on said tightening connector.

6. A retrofit switch actuator for a circuit breaker control switch in a power distribution network, said circuit breaker control switch having a control shaft rotatable movable from a first position to a second position along an axis of rotation of the control shaft, said actuator comprising:

a solenoid having an axially movable output shaft; and means for coupling the output shaft of said solenoid to said control shaft of said circuit breaker control switch and for moving said control shaft from said first position to said second position in response to movement of the solenoid output shaft without any lateral movement of the control shaft.

7. The switch actuator of claim 6, further comprising a solenoid bracket to which said solenoid is pivotably connected.

8. A retrofit actuator for a circuit breaker control switch in a power distribution network, said circuit breaker control switch having a control shaft rotatable movable from a first position to a second position along an axis of rotation of the control shaft, said actuator comprising:

a solenoid having an output shaft movable from at least a first solenoid position to a second solenoid position; and a coupler attached to the output shaft of said solenoid and adapted to be coupled to said control shaft, such that movement of said output shaft from said first solenoid position to said second solenoid position results in movement of said control shaft from said first position to said second position without any lateral movement of said control shaft.

9. The switch actuator of claim 8, further comprising a control panel electrically linked to said solenoid.

10. The switch actuator of claim 9, wherein said control panel includes a power signal line, a trip signal line, and a close signal line for said solenoid.

11. The switch actuator of claim 9, further comprising a solenoid bracket to which said solenoid is pivotably connected.

12. The switch actuator of claim 11, further comprising a cover attached to said solenoid bracket that covers said solenoid.

13. A method for retrofitting a circuit breaker control switch with a switch actuator comprising the steps of:

installing a solenoid bracket to a control shaft of said circuit breaker control switch;

securing a lever adapter onto said control shaft; and connecting a solenoid to an extension arm of said lever adapter.

14. The method for retrofitting a circuit breaker control switch with a switch actuator of claim 13 further comprising the step of energizing said solenoid from a remote location.

15. A switch actuator for a circuit breaker control switch, said circuit breaker control switch having a rotatable control switch output shaft, said switch actuator comprising:

a solenoid having an output shaft producing a rotational movement; and a connector coupled to the output shaft of the solenoid and adapted to be coupled to the control switch output shaft, said connector transferring rotational movement of the output shaft of the solenoid to the control switch output shaft to turn the control switch output shaft.

16. The switch actuator of claim 15, wherein the connector comprises:

an adapter having an upper portion mounted to said control shaft and a lower leg portion extending from said upper portion;

a link connected to the lower leg portion of the adapter; and a lever connecting the link to the output shaft of the solenoid.

17. The switch actuator of claim 16, wherein said control panel includes a power signal line, a trip signal line, and a close signal line for said solenoid.

18. The switch actuator of claim 16, wherein said adapter further comprises:

a first opening, the size of said opening large enough to accommodate the control shaft of said circuit breaker control switch; and a handle mounting shaft providing for attachment of said adapter to a handle.

19. The switch actuator of claim 15, further comprising a solenoid bracket to which said solenoid is connected.

20. The switch actuator of claim 15, further comprising a control panel electrically linked to said solenoid.

21. The switch actuator of claim 15, wherein said connector converts approximately 90 degrees of rotational movement by said solenoid into approximately 45 degrees of rotational movement by said output shaft.

22. The switch actuator of claim 15, further comprising a switch detector indicating transfer of the rotational movement of the solenoid output shaft to the control switch output shaft.

23. The switch actuator of claim 22, wherein the switch detector is a potentiometer.

24. The switch actuator of claim 15, further comprising a clutch allowing transfer of the rotational movement of the solenoid output shaft in only one direction.

25. A retrofit switch actuator for a circuit breaker control switch in a power distribution network, said circuit breaker control switch having a control shaft movable from a first position to either a second position or a third position, said actuator comprising:

a first solenoid having a first output shaft producing a clockwise rotational movement;

a second solenoid having a second output shaft producing counter-clockwise rotational movement; and a connector coupled to the first output shaft and the second output shaft, said connector transferring the clockwise rotational movement of the first output shaft to move the control shaft from the first position to the second position, and said connector transferring the counter-clockwise rotational movement of the second shaft to move the control shaft from the first position to the third position.

26. The switch actuator of claim 25, wherein the connector comprises:

an adapter having an upper portion mounted to said control shaft and a lower leg portion extending from said upper portion;

a first link connected to the lower leg portion of the adapter;

a second link connected to the lower leg portion of the adapter;

a first lever connecting the first link to the first output shaft; and a second lever connecting the second link to the second output shaft.

27. The switch actuator of claim 25, wherein the connector converts approximately 90 degrees of rotational movement by the first solenoid into approximately 45 degrees of rotational movement by the control shaft.

28. The switch actuator of claim 27 further comprising a switch detector indicating movement of the control switch output shaft from the first position to the third position.

29. The switch actuator of claim 25, further comprising a switch detector indicating movement of the control switch output shaft from the first position to the second position.

30. The switch actuator of claim 28, wherein the switch detector is a potentiometer.

31. The switch actuator of claim 25, further comprising a first clutch allowing transfer of rotational movement of the first output shaft of the first solenoid in only one direction.

32. The switch actuator of claim 31, further comprising a second clutch allowing transfer of rotational movement of the second output shaft of the second solenoid in only one direction.

33. A switch actuator for a circuit breaker control switch, said circuit breaker control switch having a rotatable control switch output shaft, said switch actuator comprising:

a solenoid having a first coil, a second coil and an output shaft, the first coil rotating the output shaft a first direction and the second coil rotating the output shaft a second direction, wherein the second direction is opposite the first direction; and a coupler connected to the output shaft of the solenoid and adapted to be connected to the control switch output shaft, said coupler transferring the rotational movement by the output shaft of the solenoid to turn the control switch output shaft.

34. A switch actuator for a circuit breaker control switch, said circuit breaker control switch having a rotatable control switch output shaft, said switch actuator comprising:

a solenoid having an output shaft producing a rotational movement;

an adapter having an upper portion adapted to be mounted to said control switch output shaft and a lower leg portion extending from said upper portion;

a link connected to the lower leg portion of the adapter; and a lever connecting the link to the output shaft of the solenoid.

* * * * *